US008041276B2

(12) United States Patent
Ogino

(10) Patent No.: US 8,041,276 B2
(45) Date of Patent: Oct. 18, 2011

(54) IMAGE FORMING APPARATUS HAVING TONER WITH SPECIFIC ADHERENCE PROPERTIES

(75) Inventor: Yasuhiko Ogino, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/718,458

(22) Filed: Mar. 5, 2010

(65) Prior Publication Data

US 2010/0226697 A1 Sep. 9, 2010

(30) Foreign Application Priority Data

Mar. 6, 2009 (JP) ..... 2009-053345
Oct. 30, 2009 (JP) ..... 2009-250255

(51) Int. Cl.
*G03G 15/01* (2006.01)

(52) U.S. Cl. ..... 399/302; 399/308

(58) Field of Classification Search ..... 399/222, 399/297–302, 308; 430/108.1, 108.7, 110.3, 430/125.3

See application file for complete search history.

(56) References Cited

U.S. PATENT DOCUMENTS

2007/0178398 A1 8/2007 Ogino et al.
2008/0187857 A1 8/2008 Ogino et al.

FOREIGN PATENT DOCUMENTS

| | | |
|---|---|---|
| JP | 6-250414 | 9/1994 |
| JP | 2001-235946 | 8/2001 |
| JP | 2004-302422 | 10/2004 |
| JP | 2004-334004 | 11/2004 |
| JP | 2005-10389 | 1/2005 |
| JP | 2008-3554 | 1/2008 |

*Primary Examiner* — Hoan Tran

(74) *Attorney, Agent, or Firm* — Oblon, Spivak, McClelland, Maier & Neustadt, L.L.P.

(57) ABSTRACT

An image forming apparatus includes a first image bearer that bears a latent image to be developed as a toner image, and a second image bearer that includes an intermediate transfer member. A first transfer device transfers the toner image from the first to the second image bearers. A second transfer device transfers the toner image from the second image bearer to a printing medium. One of the below described inequalities is satisfied when the toner has been subjected to a centrifugal force of $2.6\times10^4$ (N/m$^2$) per particle, wherein Ftp represents a non-electrostatic adherence between toner particles, Fpp represents a non-electrostatic adherence between the toner and the first image bearer, and Fbp represents a non-electrostatic adherence between the toner and the second image bearer; Fbp>Ftp, and Fbp>Fpp.

11 Claims, 7 Drawing Sheets

FIG. 12

| | Fpp | Fbp | Ftp | CONDITION | INCLINATION L | ROUNDNESS LEVEL | CENTER MISSING RANK |
|---|---|---|---|---|---|---|---|
| PRACTICAL EXAMPLE 1 | 82 | 50 | 32 | CONDITION 1 | $1.64 \times 10^{-4}$ | 1.34 | 4 |
| COMPARATIVE EXAMPLE 1 | 115 | 75 | 85 | — | $4.29 \times 10^{-4}$ | 1.55 | 1 |
| PRACTICAL EXAMPLE 2 | 85 | 52 | 41 | CONDITION 1 | $1.87 \times 10^{-4}$ | 1.21 | 5 |
| PRACTICAL EXAMPLE 3 | 59 | 75 | 85 | CONDITION 2 | $4.29 \times 10^{-4}$ | 1.55 | 5 |
| COMPARATIVE EXAMPLE 2 | 82 | 27 | 32 | — | $1.64 \times 10^{-4}$ | 1.34 | 2 |
| PRACTICAL EXAMPLE 4 | 89 | 60 | 57 | CONDITION 1 | $3.13 \times 10^{-4}$ | 1.38 | 4 |
| PRACTICAL EXAMPLE 5 | 80 | 49 | 30 | CONDITION 1 | $1.72 \times 10^{-4}$ | 1.55 | 4 |
| PRACTICAL EXAMPLE 6 | 115 | 124 | 85 | CONDITION 1 + CONDITION 2 | $4.29 \times 10^{-4}$ | 1.55 | 5 |
| COMPARATIVE EXAMPLE 3 | 64 | 43 | 51 | — | $4.50 \times 10^{-4}$ | 1.56 | 1 |
| PRACTICAL EXAMPLE 7 | 48 | 30 | 23 | CONDITION 1 | $1.85 \times 10^{-4}$ | 1.23 | 5 |
| COMPARATIVE EXAMPLE 4 | 107 | 70 | 76 | — | $3.50 \times 10^{-4}$ | 1.45 | 2 |

IMAGE FORMING APPARATUS HAVING TONER WITH SPECIFIC ADHERENCE PROPERTIES

CROSS REFERENCE TO RELATED APPLICATIONS

This application claims priority under 35 USC §119 to Japanese Patent Application Nos. 2009-053345 and 2009-250255, filed on March 6, and October 30, both 2009, respectively, the entire contents of which are herein incorporated by reference

BACKGROUND OF THE INVENTION

1. Field of the Invention

The present invention relates to an image forming apparatus, such as a copier, a facsimile, a printer, a multifunctional machine having a combination of these functions, etc., and a method of producing toner for electro-photograph use. In particular, the present invention relates to the image forming apparatus and the method capable of forming a toner image on a photoconductive member, and transferring the toner image onto an intermediate transfer member, and ultimately on a printing medium.

2. Discussion of the Background Art

In a conventional image formation process, in which component color toner images are formed and transferred from surfaces of respective photoconductive members serving as primary image bearers (e.g. latent image bearers) onto a printing medium, such as a plain paper, etc., via an intermediate transfer member serving as a second image bearer, so-called incomplete toner image transfer sometimes occurs. Such incomplete toner image transfer is prominent when either a character or line image is formed. This is because, in a contact type transfer system, a toner image is bore protruding from the surface of the photoconductive member and an image area rate of the character or line image is low, pressure created at a time of image transfer onto the intermediate transfer member readily concentrates on the toner, thereby degrading transfer efficiency. As a result, the incomplete toner image transfer occurs.

To suppress the incomplete toner image transfer, various ideas have been proposed as discussed in the Japanese Patent Application Laid Open Nos. 6-250414, 2001-235946, 2004-334004, 2005-10389, and 2008-003554.

However, admitting that the incomplete toner image transfer can be suppressed on a prescribed condition, another type of an abnormal image is created or physicality changes when used for a long term.

Further, as a result of various considerations and investigations, it is revealed that the incomplete toner image transfer from the photoconductive member to the intermediate transfer member is largely affected by a mutual relation between an adherence caused between toners, that caused between the toner and the intermediate transfer member, and that causes between the toner and a photoconductive member each after a completion force is applied thereto. Specifically, a non-electro static adherence between toners and that between the toner and the member increase in accordance with the completion force and a toner particle diameter. The incomplete toner image transfer becomes serious when the adherence between the toners exceeds than that caused between the toner and the intermediate transfer member, while the adherence caused between toners exceeds than that caused between the toner and the intermediate transfer member. However, none of the prior arts discusses the relation between the adherence caused between toners, that caused between the toner and the photoconductive member, and that caused between the toner and the intermediate transfer member after a prescribed compression force is applied to the electro photographic use toner.

SUMMARY OF THE INVENTION

The present invention has been made in view of the above noted and another problems and one object of the present invention is to provide a new and noble image forming apparatus. Such a new and noble image forming apparatus includes a first image bearer that bears a latent image and a toner image and a second image bearer that includes an intermediate transfer member. A first transfer device is provided to transfer the toner image from the first to the second image bearers. A second transfer device is provided to transfer the toner image from the second image bearer to a printing medium. One of the below described inequalities is established when the toner is subjected to a centrifugal force of $2.6\times10^4$ ($N/m^2$) per particle, wherein Ftp represents a non-electrostatic adherence between toners, Fpp represents a non-electrostatic adherence between the toner and the first image bearer, and Fbp represents a non-electrostatic adherence between the toner and the second image bearer;

In another aspect, the toner has a proportional coefficient L of a primary regression straight line not more than $3.40\times10^4$ (mm), wherein the primary regression straight line is plotted on a graph indicating a parameter Ftp/Dt [nN/μm] on a vertical axis and a parameter P ($N/m^2$) on a lateral axis. The parameter Ftp/Dt [nN/μm] representing a value obtained by dividing the non-electrostatic adherence (Ftp (nN)) between toner by an average diameter of toner (Dt (micrometer)), and the parameter P ($N/m^2$) represents a pressurizing force applied to the toner per particle. Each of the parameters being obtained after the compression of the centrifugal force.

In yet another aspect, average roundness of the toner is from not less than 1.0 to not more than 1.4.

In yet another aspect, the toner includes mixture of groups of toner having average roundness of not less than about 1.4 and that not more than about 1.4, respectively.

In yet another aspect, the average particle diameters range from about 1 to about 8 micrometer.

In yet another aspect, the toner includes mixture of at least two types of toner particles each having a different diameter from the other type.

In yet another aspect, at least two types of toner particles includes a larger particle having a diameter of from about 4 to about 8 micrometer, and a smaller particle having a diameter of from about 1 to about 4 micrometer.

In yet another aspect, a contact angle of said first image bearer with water is not less than 90 degree.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 12 is an exemplary table illustrating practical and comparative experiment examples.

PREFERRED EMBODIMENTS OF THE PRESENT INVENTION

Figure 1:
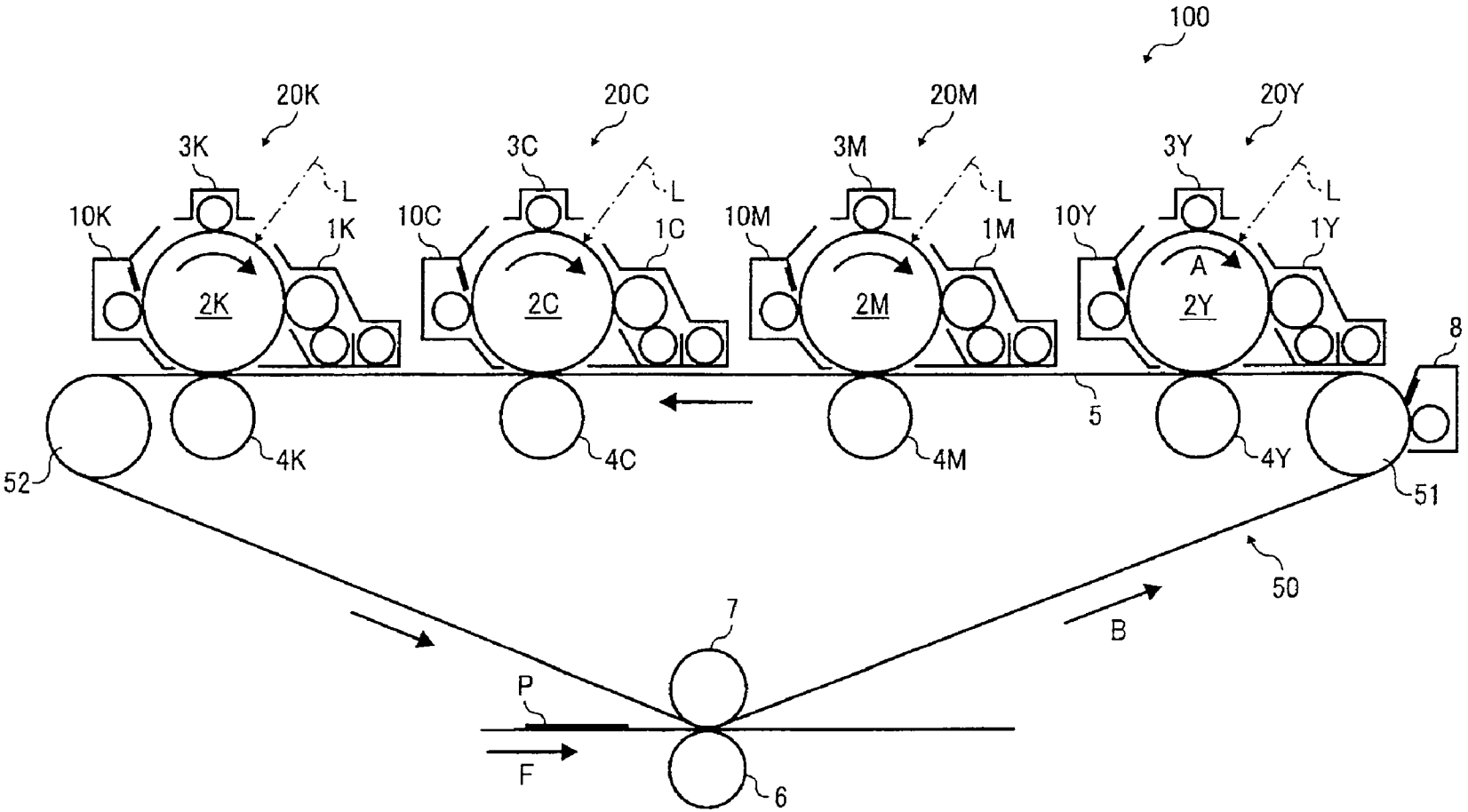
FIG. 1 schematically illustrates an exemplary full color printer according to one embodiment of the present invention.

Referring now to the drawings, wherein like reference numerals and marks designate identical or corresponding parts throughout several figures, in particular in FIG. 1, a principal part of a full color printer 100 serving as an image forming apparatus is described. As shown, the printer 100 includes image formation units 20Y to 20K employing toner of a different color from the other (i.e., yellow, magenta, cyan and black) arranged in parallel to each other. The printer 100 also includes an intermediate transfer unit 50 having an intermediate transfer belt 5 serving as an intermediate transfer member that transfers a toner image formed on the respective image formation units 20Y to 20K onto a sheet. Thus, the so-called tandem type image forming apparatus 100 is constituted with these image formation units being arranged side by side along the intermediate transfer belt 5 in a running direction thereof.

The respective image formation units 20Y to 20K include photoconductive member drums 2Y to 2K and charge devices 3Y to 3K, which charge the surface of the photoconductive members with charge rollers, and an expo device, not shown, that forms a latent image on the surface of the photoconductive members with the charge by exposing the surface with a laser light L in accordance with image information. Further included are developing devices 1Y to 1K which make the latent image on the respective photoconductive member drums 2Y to 2K into toner images, and cleaning devices which clean the surfaces of the photoconductive member drums 2Y to 2K.

These photoconductive member drums 2Y to 2K are driven rotated by a photoconductive member drum drive device, not shown, in a direction as shown by an arrow A. The black use photoconductive member drum 2K can be independently driven rotated from the color use photoconductive member drums 2Y to 2C to be only operated when a monochrome image is formed while the other color images are formed by operating the remaining photoconductive member drums 2Y to 2C at same time. Specifically, to form the monochrome image, the intermediate transfer unit is partially shifter to separate from the color use photoconductive members 2Y to 2C.

The intermediate transfer belt 5 is formed by an endless belt material having a medium resistance and is wound around plural supporting rollers of a secondary transfer section opposing roller 7 and supporting rollers 51 and 52. By driving and rotating one of the supporting rollers, the intermediate transfer belt 5 can be endlessly rotated in a direction as shown by an arrow B in the drawing.

At the primary transfer positions, where toner images are transferred from the respective photoconductive member drums 2Y to 2K onto the intermediate transfer belt 5, plural primary transfer rollers 4Y to 4K are provided opposing to those, respectively, via the intermediate transfer belt 5. The intermediate transfer belt 5 pressure contacts the photoconductive member drums 2Y to 2K while receiving pressure from the respective primary transfer rollers 4*y* to 4K, and forms primary nips at the opposing sections opposing to the respective photoconductive member drums 2Y to 2K.

Further, at the position opposing to the secondary transfer section opposing roller 7 via the intermediate transfer belt 5, there is provided a secondary transfer roller 6 that pressure contacts the intermediate transfer belt 50 with a prescribed nip pressure and transfers the toner image formed on the intermediate transfer belt 5 onto a transfer sheet P toner images.

When a color image is formed by the above-mentioned printer 100, the respective photoconductive member drums 2Y to 2K are driven rotated in a direction as shown by an arrow A, and are charged in a prescribed polarity, such as a negative polarity, by the charge devices 3Y to 3K, respectively. Then, a laser light L optically modulated is emitted from am image write device to the charged surfaces of the respective photoconductive member drums 2Y to 2K, whereby latent images are formed thereon. Specifically, surface of the photoconductive member portions, which decrease an absolute voltage vale upon receiving the laser light serve as latent images (image portions), while the other surface thereof keep the absolute voltage at the high level and serve as a background. Then, the latent images are developed to be toner images as visual images by toner charged in a prescribed polarity installed in developing devices 1Y to 1K.

The toner images of the respective colors formed on the photoconductive member drums 2Y to 2K are transferred onto the intermediate transfer belt 5 one by one by pressure at respective primary transfer nips in a transfer electric field. Thus, a four full color toner image is formed on the intermediate transfer belt 5.

The toner not transferred onto the intermediate transfer belt 5 and remaining on the respective photoconductive member drums 2Y to 2K are scraped off by the photoconductive member cleaning devices 10Y to 10K, whereby the surfaces of the photoconductive member drums 10Y to 10K are cleaned, respectively. The toner removed can be recycled by using a toner recycling device, not shown, while returning the toner to the developing device.

From a sheet-feeding device, not shown, a transfer sheet P is conveyed in a direction as shown by an arrow F at a prescribed time between the intermediate transfer belt 5 and the secondary transfer roller 6. At this moment, the full color toner image superimposed on the intermediate transfer belt 5 is transferred in a block at a secondary transfer nip formed between the secondary transfer roller 6 and the secondary transfer section opposing roller 7. The transfers P carrying the full color toner image is subjected to heat and pressure in a fixing device, not shown, whereby the toner image can be fixed thereon, and is ejected from a sheet ejection section, not shown. The toner remaining on the intermediate transfer belt 5 is scraped off by the intermediate transfer belt-cleaning device 8, whereby the surface thereof is cleaned.

Not limited to a situation where the printer 100 of FIG. 1 is employed, to improve transfer efficiency and suppress transfer unevenness in a main scanning direction in a primary transfer process of the image forming apparatus, pressure is generally applied to a transfer section to make contact.

However, due to a relation between nature of toner and the pressure at a nip, a character or line image partially drops in the transfer process or is transferred again onto the photoconductive member, whereby incomplete toner image transfer occurs. Then, in this embodiment, to widely suppress the incomplete toner image transfer, the following adjustment is executed. Specifically, an adherence caused between toner particles is designated to be less than that caused between the toner and an intermediate transfer belt, or the adherence caused between the toner and the photoconductive member is designated to be less than that caused between the toner and the intermediate transfer belt, each when a prescribed compression force is applied to the toner.

Now, an exemplary measurement method for measuring an adherence caused between toner particles, that caused between toner and a photoconductive member, and that caused between toner and an intermediate transfer belt, each after compression is described. As a method of measuring toner adherence, it is common to estimate a force needed for toner to separate from something adhering the toner. As a toner separation method, a method of using one of centrifugal force, vibration, collision, air pressure, electric field, and magnetic field or the like is well known. Among those, the centrifugal force method is advantageous for its easiness of quantification and precision, and is thus employed in this embodiment. One of the centrifugal force methods is described on page 200 IS & TNIP $7^{th}$ (1991), for example.

Figure 2:
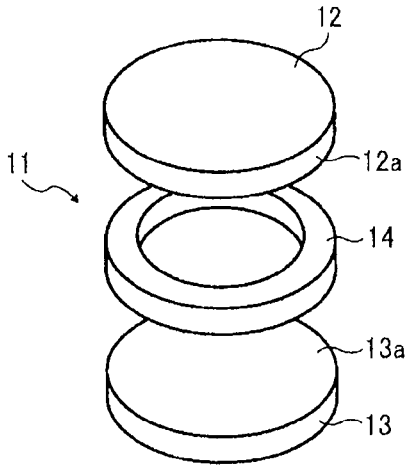
FIG. 2 illustrates an exemplary measurement cell employed in a powder adherence measuring device.
Figure 3:
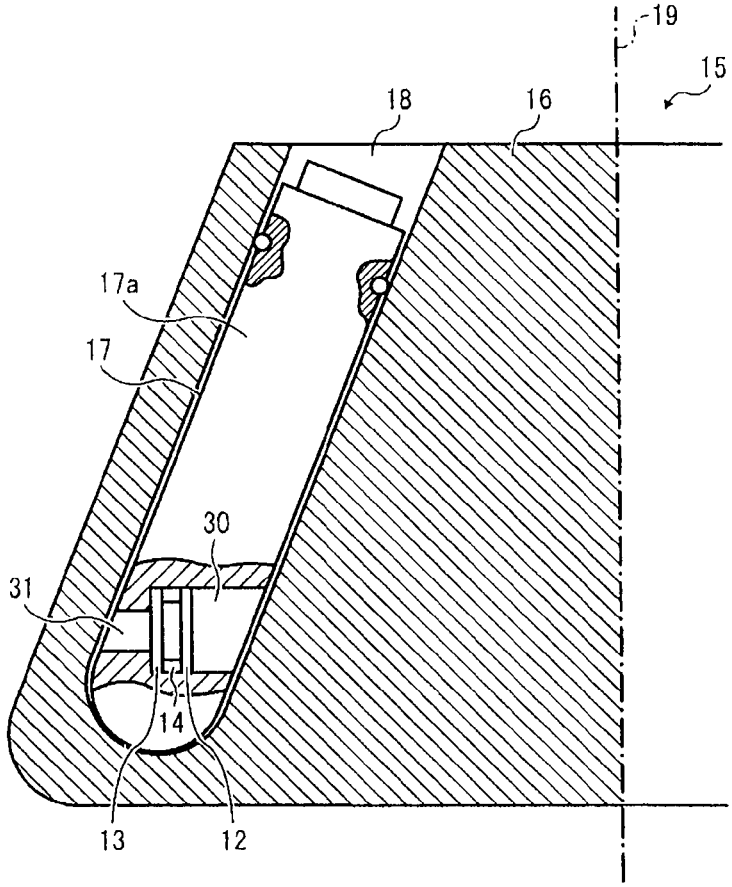
FIG. 3 illustrates an exemplary centrifugal separation device included in the powder adherence measuring device.

Now, an exemplary device that measures an adherence is described with reference to FIGS. 2 and 3. As shown, an exemplary measurement cell and a centrifugal force separation device are illustrated. In FIG. 2, 11 denotes a measurement cell that includes a sample substrate 12 having a sample surface 12*a* for placing toner thereon, a reception substrate 13 having an attraction surface 13*a* receiving the toner separated from the sample substrate 12, and a spacer 14 arranged between the sample surface 12*a* and the attraction surface 13*a*. As shown in FIG. 3, a centrifugal force separation device 15 includes a rotor 16 that rotates the measurement cell 11 and a holding member 17. The rotor 16 includes a sample attaching section 18 having a hole to accommodate the holding member 17. The holding member 17 includes a bar state section 17*a*, a cell holding section 30 arranged on the bar state section 17*a* to hold the measurement cell 11, and a hole section 31 for pushing out the measurement cell 141 from the cell holding section 30. The cell holding section 30 directs the measurement cell 11 perpendicular to the rotational axis 19 of the rotor when attached.

Now, an exemplary method of measuring an adherence of toner using a centrifugal force is described with reference to FIG. 3. Initially, a photoconductive member is either directly produced on the sample substrate 12 is partially carved away and adhered to the sample substrate 12. Then, toner is place and adhered onto the photoconductive member (i.e., the sample surface 12*a*) on the sample substrate 12. As shown, the measurement cell 11 is arranged in the cell holding section 30 such that the sample substrate 12 positions between the reception substrate 13 and the rotor rotational axis 19 when the holding member 17 is attached to the sample attaching section 18. The holding member 17 is installed in the sample attaching section 18 so that the axis of the measurement cell is arranged perpendicular to the rotor rotational axis 19. The centrifugal separation device 15 is operated to rotate the rotor 16 at a prescribed rpm. When toner attracting to the sample substrate receives the centrifugal separation force larger than the adherence existing between the toner and the sample surface 12*a* in accordance with the rpm, the toner separates from the sample surface 12*a* and attracts to the attraction surface 13*a*.

The centrifugal force F is calculated by the following formula 1, wherein m represents weight of toner, f (rpm) represents a number of rotations per minute, and r represents a distance from the rotor rotational axis to a toner attraction surface of the sample substrate;

$$F=m\times r\times(2\pi f/60)^2. \quad \text{(Formula 1).}$$

The weight of the toner is calculated by the following formula 2, wherein "ρ" represents real specific gravity, and d represents a diameter (that corresponds to a circle) of the toner;

$$M=(\pi/6)\times\rho\times d^3. \quad \text{(Formula 2)}$$

Based on the above-mentioned formulas, the centrifugal force F applied to the toner can be obtained by the following formula 3;

$$F=(\pi^3/5400)\times\rho\times d^3\times r\times f^2. \quad \text{(Formula 3)}$$

After the centrifugal separation is completed, the holding member 17 is removed from the sample attaching section 18, and the measurement cell 11 is removed from the cell holding section 17*b*. Then, the reception substrate 13 is replaced with a new and the measurement cell 11 is attached to the holding member 17, and the holding member 17 is then attached to the rotor 16. Then, the rotor 16 is rotated at a higher speed than before. Thus, the centrifugal force applied to the toner increases, and the toner having large adherence separates from the sample surface 12*a* and attracts to the attraction surface 13*a*.

By similarly repeating the above while changing the rpm of the centrifugal separation device from low to high, the toner on the sample surface 12*a* moves to the attraction surface 13*a* in accordance with a largeness relation between a centrifugal force created per rpm and an adherence. When all of centrifugal separation is executed for all of setting rpms, a particle diameter of the toner attracting to the attraction surface 13*a* is measured per the rpm, and an adherence can be calculated using the formula 3. The measurement of the number and particle diameter of the toner is executed by observing the toner on the attraction surface 13*a* using an optical microscope, inputting an image taken by the scope to an image processing device via a CCD camera, and measuring the particle diameter of the respective toners in the information processing device.

A common logarithm distribution of the adherence existing between the toner and the photoconductive member is then obtained. Such a distribution changes in accordance with various conditions, such as toner average particle diameter, particle diameter distribution, shape, material, additives, etc.

Figure 4:
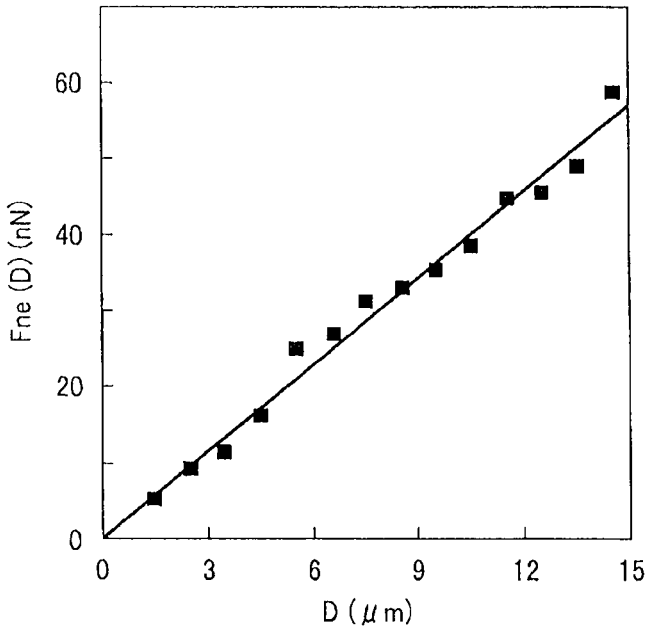
FIG. 4 illustrates an exemplary relation between an average Fne of a non-electrostatic adherence between toner and a photoconductive member and an average diameter D of toner particle.

Since the particle diameter of each of the toners attracting to the attraction surface 13*a* is measured, an average of the adherence can be obtained per particle diameter. Thus, by measuring the adherence only once, a relation between the average particle diameter and the adherence can be obtained. As shown in FIG. 4, an average Fne (D) of non-electrostatic adherence per particle diameter is proportional to the average particle diameter D. A liner line represents a primary regression straight line of the measured value having a proportional coefficient K. When the same composition material is used for toner having different particle diameter distribution or average particle diameter, an average Fav of the total non-electrostatic adherence of the toner becomes different. However, the proportional coefficient K does not rely on either the particle diameter distribution nor average particle diameter. Thus, by using the coefficient K, a largeness of the toner adherence can be compared regardless of the difference of either the particle diameter distribution or the average particle diameter.

When an adherence after the compression is measured, the sample substrate 12 having the sample surface 12*a*, an adherence of which to toner is to be measured, and the reception substrate 13 change their places shown in FIG. 3 (i.e., sawap) to each other. Then, the centrifugal separation device 5 is operated. Thus, the toner particle attracting to the sample substrate 12 is depressed by a centrifugal force to the sample surface 12*a* in accordance with the rpm of the rotor. The depression force P applied to the toner can be calculated by the formula 4.

$$P=(\pi^3/5400)\times\rho\times d^3\times r\times f^2/(\pi\times d^2/4) \quad \text{(Formula 4)}$$

The adherence between the toner and the sample surface 12*a* is measured by the above-mentioned adherence-measuring manner after the compression. The measured adherence is proportional to the compression force applied to the toner. The measurement is practice on three conditions in this example in which a photoconductive member is adhered to the sample substrate 12, an intermediate transfer belt is adhered there onto, and a toner particle layer is adhered thereto. The toner particle layer is produced by similarly adhering toner onto the sample substrate 12 with adhesive as mentioned above by removing a surface layer not secured thereto with the adhesive.

With the above-mentioned centrifugal separation manner, a non-electrostatic adherence caused after the compression between toners of various types are measured and quantized, and are then evaluated. Specifically, incomplete toner image transfer phenomenon caused in the image forming apparatus is investigated.

Figure 5:
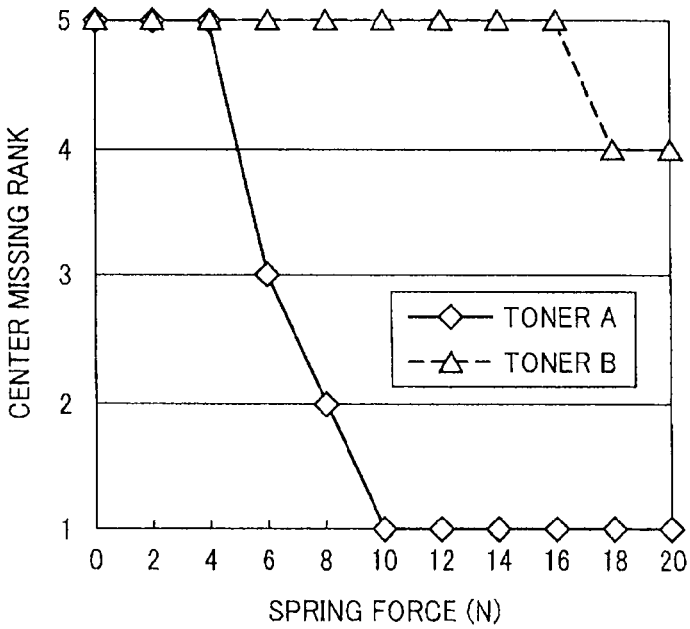
FIG. 5 illustrates an exemplary relation between a spring force of a secondary transfer section and a rank of incomplete toner image transfer when two types of toner samples are used.

As shown, an exemplary relation between a transfer compression spring force is measured and a rank of incomplete toner image transfer is obtained by optionally employing two different nature toner samples A and B in an existing image forming apparatus as shown in FIG. 5. The image forming apparatus is a tandem type full color printer employing an intermediate transfer system that operates in a single color mode and outputs respective mono color images while changing a transfer pressure. As shown, the transfer compression spring force represents a level of a spring force for assisting the transfer by pressurizing the intermediate transfer belt against the photoconductive member at a printing medium transfer section. Two compression spring members are arranged at respective side ends of a transfer roller, and accordingly, the transfer pressurizing force is the sum of the spring forces. As shown, using a test chart having uniformly arranged thin lines of three dots in the main scanning direction and 60 dots in the sub scanning direction, conditions of the incomplete toner image transfer outputted on images are ranked from first to five steps to be evaluated as mentioned below. The test chart is designed to handle a low image area rate character or line image or the like, in which pressure readily concentrates on a toner image. The fifth rank represents a condition, in which incomplete toner image transfer is not visually observed. The fourth rank represents a condition, in which incomplete toner image transfer is hardly but barely visually observed. The third rank represents a condition, in which incomplete toner image transfer is barely visually observed, but does not deteriorate image quality. The second rank represents a condition, in which incomplete toner image transfer is relatively readily visually observed. The first rank represents a condition, in which incomplete toner image transfer is immediately visually observed by ever observers.

The ranks higher than the fourth do not raise a problem of image quality. The spring force larger than 16 (N) exceeds a normally used level. In this way, as understood from the evaluation, a relation between the spring force and the incomplete toner image transfer rank is different depending on the toner. Specifically, the toner sample B preferably shows a higher possibility of avoiding the incomplete toner image transfer among those in FIG. 5.

Figure 6:
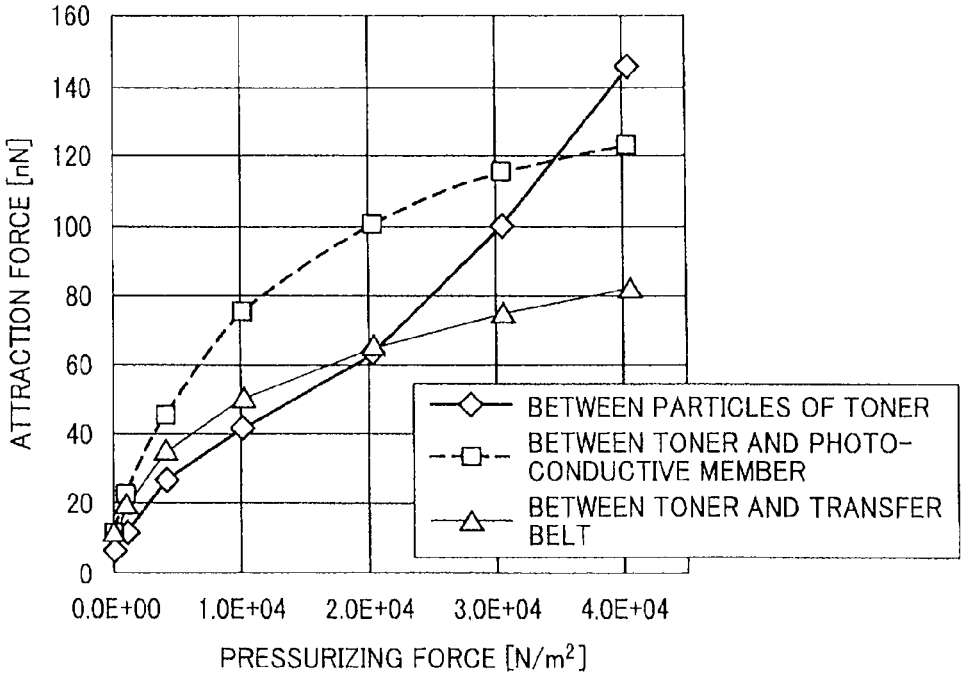
FIG. 6 graphically illustrates an exemplary adherence of toner A in relation to a compression force.
Figure 7:
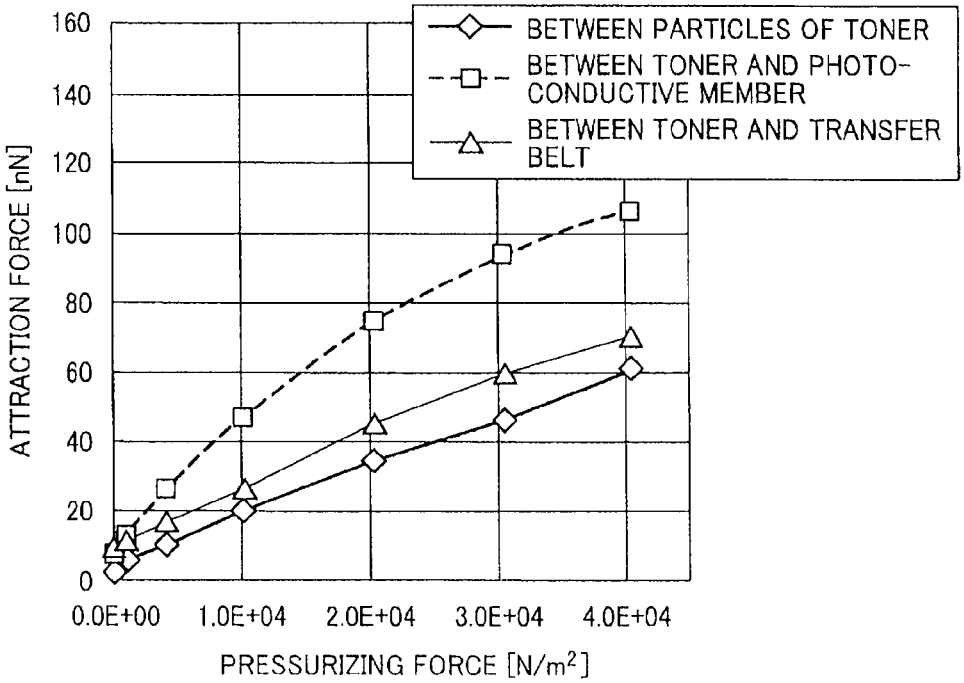
FIG. 7 graphically illustrates an exemplary adherence of toner B in relation to a compression force.

Then, a non-electrostatic adherence Ft caused between toner particles, a non-electrostatic adherence Fpc caused between toner and a photoconductive member, and a non-electrostatic adherence Fbp caused between toner and an intermediate transfer belt are measured as to toner samples A and B while applying plural compression stresses thereto by using the centrifugal separation manner using the photoconductive member and the intermediate transfer belt as used in the experiment of FIG. 5. As shown in FIGS. 6 and 7, the sample toner A that easily showed the incomplete toner image transfer in FIG. 5 shows that the adherence Ftp exceeds that of Fbp, while the adherence Fpp exceeds that of Fbp when a larger compression force is applied thereto as shown in FIG. 6.

Specifically, when the toner average particle diameter Dt of the toner sample A is about 7.0 micrometer and the compression forced is $2.6\times10^4$ (N/m2), the Fbp, Ftp, and Fpp become 75, 85, and 115 (nN), respectively. The values for the compression force $2.6\times10^4$ ($N/m^2$) are obtained using straight-line approximation based on the compression force measurement results executed at around $2.6\times10^4$ ($N/m^2$). Whereas the sample toner B that hardly showed the incomplete toner image transfer at a large spring force shows that the adherence Ftp is less than that of the Fbp even when a large compression force is applied thereto as shown in FIG. 7. Specifically, when the toner average particle diameter Dt of the toner sample B is about 7.0 micrometer and the compression forced is $2.6\times10^4$ (N/m2), the Fbp and the Ftp become 52 and 41 (nN), respectively. The values of the compression force $2.6\times10^4$ ($N/m^2$) are obtained using straight line approximation based on the compression force measurement results executed at around $2.6\times10^4$ ($N/m^2$).

Figure 8:
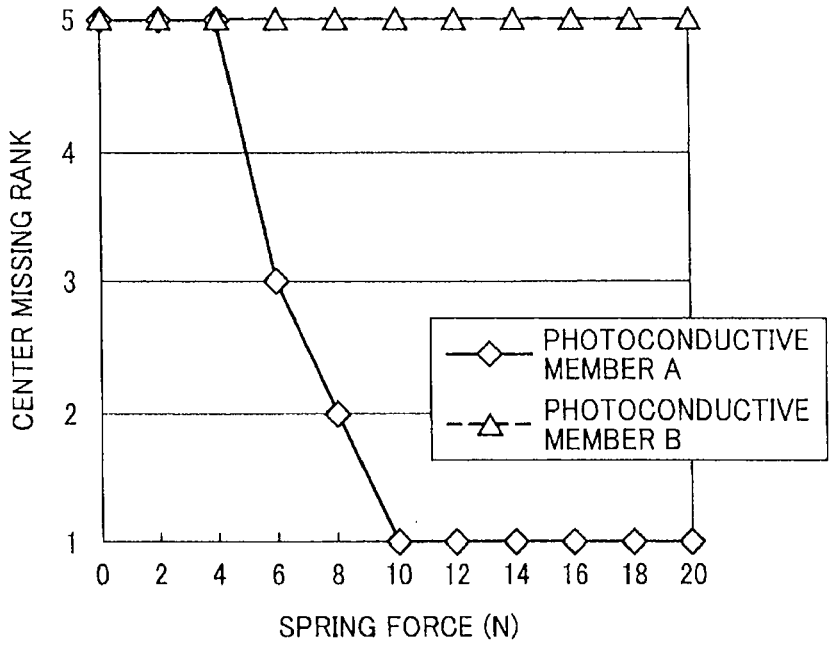
FIG. 8 illustrates an exemplary relation between a spring force of a secondary transfer section and a rank of incomplete toner image transfer when two types of photoconductive member samples are used.
Figure 9:
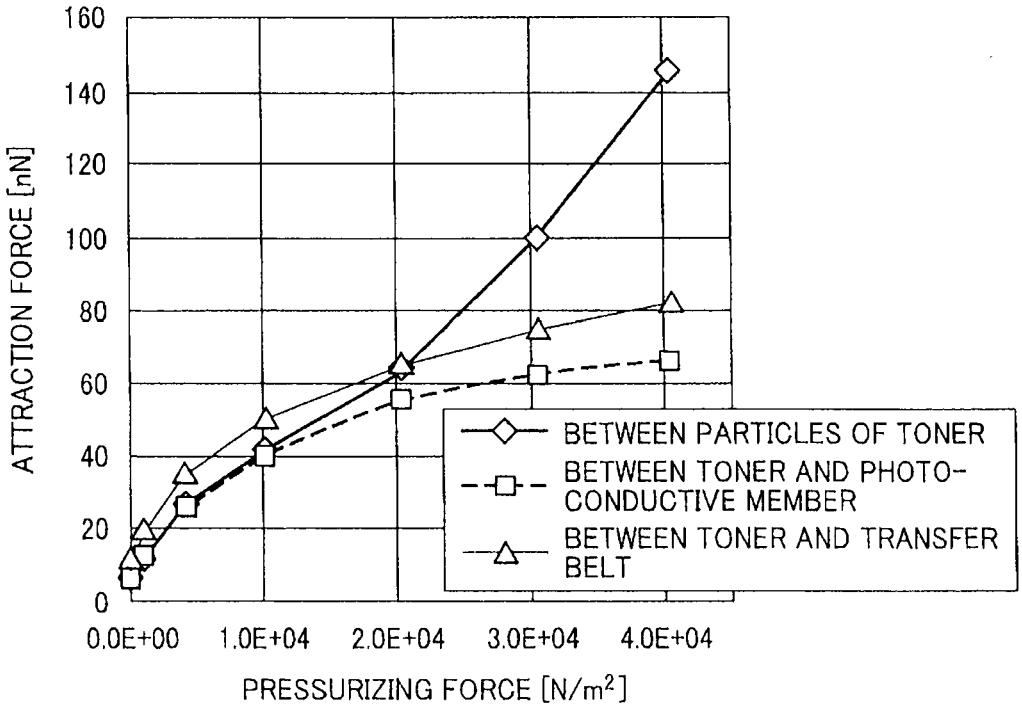
FIG. 9 graphically illustrates a second exemplary adherence of the toner A in relation to the compression force.

Subsequently, the measurement is newly but similarly executed as in FIG. 5 using the toner sample A by replacing the photoconductive member A of the image forming apparatus used in the experiment of FIG. 5 with a photoconductive member B of a different nature as shown in FIGS. 8 and 9. As shown, the photoconductive member B that hardly showed the incomplete toner image transfer in FIG. 8 shows that the adherence Fpp is less than that of the Fbp when a larger compression force is applied thereto as shown in FIG. 9. Specifically, when the toner average particle diameter Dt of the toner sample A is about 7.0 micrometer and the compression force is $2.6\times10^4$ ($N/m^2$), the Fbp, Ftp, and Fpp become 75, 85, and 59 (nN), respectively.

As a result of various investigations of the above-mentioned relation between the non-electrostatic adherence of toner and the compression force applied thereto, and that between the transfer spring force and the incomplete toner image transfer, the applicants have found out that the incomplete toner image transfer can be suppressed if the below described condition is met.

Specifically, usage toner satisfies the below described inequality formula 5, wherein Fbp represents a non-electrostatic adherence caused between the toner and the intermediate transfer belt, Ftp represents that caused between the toner particles, and Fpp represents that caused between the toner and the photoconductive member when the toner is compressed by a centrifugal force of $2.6\times10^4$ ($N/m^2$) per particle:

$$Fbp>Ftp, \text{ or } Fbp>Fpp \quad \text{(Formula 5)}$$

Figure 10:
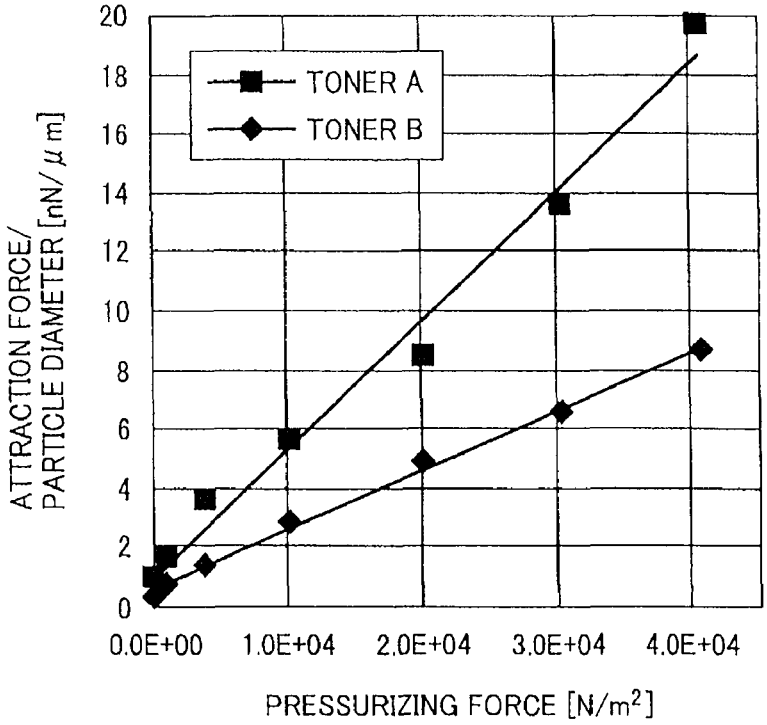
FIG. 10 illustrates an exemplary relation of between Ftp/Dt and the compression force when two types of toner samples are used.

Further, since the smaller the adherence between toners after the compression, the more types of the members are handled, adherence between toners after the compression is preferable as smaller as possible. FIG. 10 is drawn by plotting Ftp/Dt (nN/micrometer) on a vertical axis and compression force p ($N/m^2$) per particle on a lateral axis, wherein the Ftp/Dt (nN/micrometer) represents a non-electrostatic adherence between toners when measured by the centrifugal separation manner after application of compression force of the centrifugal force, while the Dt represents an average toner particle diameter. The smaller the inclination, the smaller the adherences between toners after the compression. When the adherence between toners is small after the compression, the incomplete toner image transfer can be readily suppressed even though the photoconductive member and the intermediate transfer belt change their natures. Since the adherence between the toners, that between the toner and the photoconductive member, and that between the toner and the intermediate transfer belt are proportional to the toner particle diameter, a value obtained by dividing the adherence by the particle diameter can be represented and compared. Specifically, it is preferable to use toner having a proportional coefficient L of a primary regression straight line of less than $3.40\times10^4$ (l/micrometer), which is defined on a graph having both a vertical axis that represents Ftp/Dt (nN/micrometer) and a lateral axis that represents compression force applied by the centrifugal force per particle.

Further, it is found preferable for a toner particle such that an average roundness represented by the following formula 6 is from 1.0 to 1.4 in order to meat the above-mentioned condition:

$$\text{Roundness}=((\text{Circumferential length of particle})^2/\text{Projection area of particle})\times 1/4\pi \quad \text{(Formula 6)}$$

The roundness of a perfect spherical form is 1.0, and the smaller the value the nearer to the spherical particle. Further, the smaller the roundness, i.e., the nearer to the spherical form, the less the value obtained by dividing the toner non-electrostatic adherence Ftp by the toner average particle diameter Dt increases. Whereas when the average of the roundness exceeds 1.4, an aggregation performance increases, and accordingly, toner readily agglutinates and causes incomplete toner image transfer when compression force is applied thereto.

To measure the roundness, FE-SEM (S-4500) manufactured by Hitachi, Ltd., is used, and one hundred toner images expanded 1000 times are sampled. Information of the resultant images is then analyzed and calculated in a prescribed manner using image processing software (e.g. Image-Pro Plus manufactured by Media Cybernetics).

As mentioned heretofore, the closer to 1.0 the roundness of the toner, the more the suppression of the incomplete toner image transfers. Since the toner having the roundness closer to 1.0 hardly creates the incomplete toner image transfer and its transfer rate is high, an amount of the remaining toner decreases. However, removal of the toner remaining after the transfer becomes difficult. This is because, if the toner is spherical, the toner rotates and passes through a gap between the photoconductive member or the surface of the intermediate transfer member and the cleaning blade when the cleaning blade removes the toner remaining after transfer. As a result of measuring of a few samples, it is known that the roundness is preferably more than 1.25.

Considering the cleaning performance, the roundness is better as larger as possible than 1.0, and almost spherical toner having the roundness of almost 1.0 can chemically be produced using polymerization method, readily. However, an irregular shaping step need be additionally included in a process of producing the toner, resulting in disadvantage of technical limitation and cost than producing the spherical toner. Whereas when toner produced by using the smashing system has a roundness of about 1.5 to 2.0, a process or rounding the surface with heat, etc., is needed to minimize the roundness. Thus, nonetheless, the additional production step is accompanied as disadvantages of technical limitation and cost. To resolve such problems, if polymerized toner of the roundness less than 1.4 is mixed with smashed toner of the roundness more than 1.4, the incomplete toner image transfer phenomenon can be suppressed improving a cleaning performance. By thus blending, the smashed toner hardly aggregates and avoids incomplete toner image transfer phenomenon. Further, due to blending the smashed indeterminate form toner with the spherical one, the cleaning performance can be improved. This is considered because when the indeterminate form toner is involved, it suppresses rotation of the spherical toner particle or clogs at the gap between the photoconductive member for the cleaning blade and the spherical toner is blocked to enter the gap.

Further, a cubic average particle diameter employed in the several embodiments of the present invention is preferably from 1 to 8 micrometer. The smaller the toner average particle diameter Dt (micrometer), the higher the adherence or aggregation performance. As a result, the toner particle extraordinarily hardly moves and controlling thereof becomes harder. As to the cubic average particle diameter, when the toner average particle diameter Dt (micrometer) is less than 1 micrometer, image formation becomes difficult. When the toner average particle diameter Dt (micrometer) is not less than 8 micrometer, a required high image quality of an electro-photographic image can hardly be met sometimes The electro-photograph use toner used in the embodiment is preferably obtained by blending more than two types of toner of different average particle diameter. Especially, a large particle diameter toner group more than about 4 to 8 micrometer is preferably blended with a small particle diameter toner group less than about 1 to 4 micrometer. It is found when a non-electrostatic adherence between toners is measured after compression executed in the centrifugal separation that an inclination L of the Ftp/Dt (nN/micrometer) in relation to the compression force easily decreases to a low level when the replenishing rate to the toner increases. This is considered because the toner mutually supports with each other at many contact points and become to hardly deform against the pressure whereby the non-electrostatic adherence hardly increases, when the replenishing rate increases. Such a replenishing rate can be increased by blending different diameter particles such that the smaller diameter particles enter gaps between the larger diameter particles so as to form a layer.

As a manner of blending and using toner of different shapes and average particle diameters, a bottle that stores toner at prescribed blending rate can be attached to an image forming apparatus when the image forming apparatus is shipped. In such a situation, since such blend usage is similarly executed as an ordinary toner replacement operation, it is not burdensome for a user. Further, in a unit in which toner is mixed and stirred with carrier, toner of a different shape can be similarly mixed and stirred with each other. In such a situation, the toner of different shape and particle diameter each separately encapsulated can be mixed and stirred with each other when mixed and stirred with the carrier. Otherwise, the toner of different shape and particle diameter can be previously blended with developer including mixture of toner and carrier. Thus, if the toner of different shape and particle diameter are separately supplied and a blending ratio of the toner is adjusted in accordance with a condition, an aggregation thereof can be suppressed.

All of known material toner can be basically used in this embodiment of the image forming apparatus.

As a binder resin, styrene, such as polystyrene, polypchlorostyrene, polyvinyl toluene, etc., and polymer of its derivative substitution are exemplified.

Specific examples of the materials for use in the fourth layer 11*d* include polycarbonate resins, fluorine-containing resins (such as ETFEs and PVDFs), homopoloymers or copolymers of styrene or styrene derivatives such as polystyrene resins, chloropolystyrene resins, poly-α-methylstyrene resins, styrene-butadiene copolymers, styrene-vinyl chloride copolymers, styrene-vinyl acetate copolymers, styrene-maleic acid copolymers, styrene-acrylate copolymers (e.g., styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (e.g., styrene-methyl methacrylate copolymers, styrene-ethyl methacrylate copolymers, and styrene-phenyl methacrylate copolymers), styrene-methyl α-chloroacrylate copolymers, and styrene-acrylonitrile-acrylate copolymers; methyl methacrylate resins, butyl methacrylate resins, ethyl acrylate resins, butyl acrylate resins, modified acrylic resins (e.g., silicone-modified acrylic resins, vinyl chloride resin-modified acrylic resins, and acrylic urethane resins), vinyl chloride resins, vinyl chloride-vinyl acetate resins, rosin-modified maleci acid resins, phenolic resins, epoxy resins, polyester resins, polyester polyurethane resins, polyethylene, polypropylene, polybutadiene, polyvinylidene chloride, ionomer resins, polyurethane, silicone resins, ketone resins, ethylene-ethyl acrylate copolymers, xylene resins, polyvinyl butyral, polyamide modified phenylene oxide resins, etc. These resins are used alone or in combination.

The toner of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner. When the content of the colorant is less than 1% by weight, the toner tends to have a low tinting power. In contrast, when the content is greater than 15% by weight, the colorant cannot be well dispersed in the toner, resulting in deterioration of the tinting power and electric properties of the toner.

A toner manufacturing method used in this embodiment is not limited to one, and can optionally employ many methods in accordance with a purpose.

However, since toner of a small cubic average particle diameter is preferably used for forming a high quality toner image, the below-described polymerizing method is preferably employed.

For example, a step of obtaining toner by dispersing active hydrogen group inclusion chemical compound, polymer including a portion capable of reacting to the active hydrogen group inclusion chemical compound, and at least two resin fine particles to cause reaction of those in water type solvent and produce earth temperature adhesive substrate is included, and the other steps are optionally employed upon need.

In the above-mentioned step, for example, water system and organic solvent phase conditioning, emulsification or dispersion, the other, such as composition of prepolymer capable of reacting with the above-mentioned active hydrogen group inclusion chemical compound, a composition of the above-mentioned active hydrogen group inclusion chemical compound, etc. The conditioning of the above-mentioned water system solvent phase can be executed by dispersing at least two types of resin fine particles into the above-mentioned water system solvent. An amount of addition of the resin fine particles to the water system solvent is optionally determined and is preferably from about 0.5 to about 10 weight %.

The conditioning of the above-mentioned organic solvent phase can be executed by either melting or dispersing toner material of the above-mentioned active hydrogen group inclusion chemical compound, prepolymer capable of reacting with the above-mentioned active hydrogen group inclusion chemical compound, colorant, releasing agent, charge control agent, and native polyesther resin or the like into the above-mentioned organic solvent.

The above-mentioned components of the toner material other than the prepolymer may be additionally mixed into the water system solvent when the resin fine particle is dispersed into the water system solvent or mixed there into together with the above-mentioned organic solvent when the organic solvent phase is added to the above-mentioned water system solvent phase in the water solvent phase conditioning.

Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, ester solvents are preferably used and ethyl acetate is more preferably used because of being capable of dissolving polyester resins. The weight ratio (S/T) of the organic solvent (S) to the toner constituents (T) is not particularly limited, but is generally from 40/100 to 300/100, preferably from 60/100 to 140/100 and more preferably from 80/100 to 120/100.

The above-mentioned emulsion or dispersion can be performed by emulsifying or dispersing a previously conditioned organic solvent phase into a previously conditioned water system solvent phase.

Then, when an active water group inclusion chemical compound and a prepolymer capable of reacting to the active water inclusion chemical compound are subjected to an expansion reaction process or a cross-linkage reaction process during the emulsion or dispersion, the above-mentioned adhesive substrate is produced.

Such an adhesive substrate, such as the above-mentioned urea denaturation polyester, etc., can be produced as follows:

For example, an organic solvent phase including prepolymer, such as isocianate group inclusion polyester prepolymer (A), etc., capable of reacting to the above-mentioned active hydrogen group inclusion chemical compound, is emulsified or dispersed into a water system solvent phase together with an active hydrogen group inclusion chemical compound, such as amine class (B), etc., whereby a dispersing element is produced. Then, these? are subjected to an expansion reaction process or a cross-linkage reaction process in the water system solvent phase.

Otherwise, the above-mentioned organic solvent phase can be emulsified or dispersed into a water system solvent in which an active hydrogen group inclusion chemical compound is previously added, and a dispersing element is produced. Then, these? are subjected to an expansion reaction process or a cross-linkage reaction process in the water system solvent phase.

Yet otherwise, the above-mentioned organic solvent phase can be additionally mixed into a water system solvent, and after than active hydrogen group inclusion chemical compound is added, whereby a dispersing element is produced. Then, these? are subjected to an expansion reaction process or a cross-linkage reaction process in the water system solvent phase from a particle boundary.

In the latest situation, denaturalized polyester resin can be produced on a toner surface in a first priority, and dins inclination can be provided among? toner particles.

The reaction condition for producing an adhesive substrate by means of emulsion and dispersion is not limited to a prescribed manner, and can be optionally selected in accordance with a combination between prepolymer capable of reacting to an active hydrogen group inclusion chemical compound and the active hydrogen group inclusion chemical compound.

A reaction time period is preferably from 10 minutes to 40 hours, and more preferably from 2 to 24 hours.

A reaction temperature is preferably from 0 to 150 degree centigrade, and more preferably from 40 to 98 degree centigrade.

A manner of constantly precisely producing the above-mentioned dispersion element in the above-mentioned water system solvent phase, prepolymer, such as isocianate group inclusion polyester prepolymer (A), etc., capable of reacting to an active hydrogen group inclusion chemical compound, which is melted or dispersed into an organic solvent, colorant, releasing agent, charge control agent, and natural polyester resin or the like are added to the above-mentioned water system solvent phase, and are then dispersed using a shearing force, for example.

Such a dispersion manner is not limited to one and is optionally chosen using a known dispersion machine or the like.

Such a dispersion machine includes one of low and high speed shearing system types, a friction system type, a high pressure jet system type, and an ultra sonic type or the like.

Among those, the high-speed shearing system type is most preferable due to capability of adjusting the average particle diameter of the dispersion element from 2 to 20 micrometer.

Further, when the high-speed shearing system type is employed, a rpm, dispersion time period and temperature or the like are not limited to prescribed manners, respectively.

The rpm is preferably from 1000 to 30000, and more preferably from 5000 to 20000.

The dispersion time period is preferably from 0.1 to 5 minutes.

The dispersion temperature is preferably from 0 to 150 degree centigrade, and more preferably from 40 to 98 degree centigrade under compression.

If the dispersion temperature is high, dispersion is generally easy.

In the above-mentioned emulsion or dispersion process, as a usage amount of the water system solvent, 50 to 2000 parts in relation to toner material 100 parts is preferable, and more preferable range is from 100 to 1000 parts.

Specifically, if it is less than 50 pts, a dispersion condition is not fine, and a toner particle having a prescribed average particle diameter is not obtained sometimes. Whereas when it is more than 2000 pts, production is costly.

In the above-mentioned emulsion or dispersion process, in view of stable dispersing, a dispersion agent is preferably used upon need.

Such a dispersion agent is not limited to one and includes one of surface active agent, hard water solution organic chemical compound dispersion agent, and polymer molecule type protection choroid or the like.

One or combination of these types can be used.

Among those, the surface active agent is most preferably used.

As the surface-active agent, negative, positive, and non-ion surface-active agents and both performance surface-active agent are exemplified.

Suitable surfactants for use as dispersants include anionic surfactants, cationic surfactants, nonionic surfactants, and ampholytic surfactants. Suitable anionic surfactants include alkylbenzene sulfonic acid salts, α-olefin sulfonic acid salts, and phosphoric acid salts. It is preferable to use fluorine-containing surfactants. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11) oxy}-1-alkyl (C3-C4) sulfonate, sodium 3-{omega-fluoroalkanoyl (C6-C8)-N-ethylamino}-1-propanesulfonate, fluoroalkyl (C11-C20) carboxylic acids and their metal salts, perfluoroalkylcarboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the marketed products of anionic surfactants having a fluoroalkyl group include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Suitable cationic surfactants include amine salt-based surfactants and quaternary ammonium salt-based surfactants. Specific examples of the amine salt-based surfactants include alkyl amine salts, aminoalcohol fatty acid derivatives, polyamine fatty acid derivatives and imidazoline. Specific examples of the quaternary ammonium salt-based surfactants include alkyltrimethyl ammonium salts, dialkyldimethyl ammonium salts, alkyldimethyl benzyl ammonium salts, pyridinium salts, alkyl isoquinolinium salts and benzethonium chloride. It is preferable to use fluorine-containing cationic surfactants.

Specific examples of the cationic surfactants having a fluoroalkyl group include primary, secondary and tertiary aliphatic amino acids having a fluoroalkyl group, perfluoroalkyl (C6-C10) sulfoneamidepropyltrimethylammonium salts, benzalkonium salts, benzetonium chloride, pyridinium salts, imidazolinium salts, etc.

Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Suitable nonionic surfactants include fatty acid amide derivatives, and polyhydric alcohol derivatives. Suitable ampholytic surfactants include alanine, dodecyldi (aminoethyl) glycin, di(octylaminoethyle) glycin, and N-alkyl-N, N-dimethylammonium betaine.

Suitable inorganic dispersants hardly soluble in water include tricalcium phosphate, calcium carbonate, titanium oxide, colloidal silica, hydroxyapatite, etc.

Suitable polymer protection colloids include homopolymers and copolymers of acid monomers, (meth) acrylic monomers having a hydroxyl group, vinyl alcohol and ethers of vinyl alcohol, esters of vinyl alcohol and compounds having a carboxyl group, amides and methylol compounds thereof, acid chlorides, and monomers having a nitrogen atom or a heterocyclic ring including a nitrogen atom; polyoxyethylene resins; and cellulose compounds.

Specific examples of the acid monomers include acrylic acid, methacrylic acid, α-cyanoacrylic acid, α-cyanomethacrylic acid, itaconic acid, crotonic acid, fumaric acid, maleic acid and maleic anhydride.

Specific examples of the acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide.

Specific examples of the ethers of vinyl alcohol include vinyl methyl ether, vinyl ethyl ether and vinyl propyl ether.

Specific examples of the esters of vinyl alcohol with a compound having a carboxyl group include vinyl acetate, vinyl propionate and vinyl butyrate.

Specific examples of the acrylic amides include acrylamide, methacrylamide, and diacetoneacrylamide.

Specific examples of the acid chlorides include acrylic acid chloride and methacrylic acid chloride.

Specific examples of the monomers having a nitrogen atom or a heterocyclic ring having a nitrogen atom include vinyl pyridine, vinyl pyrrolidone, vinyl imidazole and ethylene imine.

Specific examples of the polyoxyethylene resins include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters.

Specific examples of the cellulose compounds include methyl cellulose, hydroxyethyl cellulose and hydroxypropyl cellulose.

In the above-mentioned emulsion or dispersion process, a dispersion stabilize agent is preferably used upon need.

As the surface stabilize agent, material such as calcium phosphate salt capable of being melted by to acidum or alkalies are exemplified.

When the surface stabilize agent is used, the calcium phosphate salt is melted by acidum such as hydrochloric acid, and is then either washed or resolved by ferment or the like, whereby the calcium phosphate salt is removed.

In the above-mentioned emulsion or dispersion process, a catalytic agent of the above-mentioned expansion or cross-linked reaction type? can be employed.

As the catalytic agent, dibutyltin laurate and dioctyltin laurate or the like are exemplified.

From emulsification slurry obtained in the above-mentioned emulsion or dispersion process, organic solvent is removed.

Such a removal is executed by one of the following manners:

For example, temperature of the entire reaction system is gradually increased, and the organic solvent in liquid drop is completely vaporized and removed.

Otherwise, emulsification dispersion element is sprayed into dry ambient and non water solubility organic solvent is completely removed whereby a toner fine particle is produced, while water system dispersion agent is vaporized and removed.

When the organic solvent is removed, the toner particle is produced.

The toner particle is washed and dehydrated or the like.

Further, it is then classified upon need.

Such classification is performed in liquid by removing a fine particle section by one of a cyclone separator, a decanter, and a centrifugal separation or the like.

The classification can be executed when obtaining the toner particle as a powder after completion of dehydration thereof.

By blending the toner particle thus obtained with one of colorant, releasing agent, and charge control agent or similar particle, or further applying mechanical impactive force thereto, the particle, such as releasing agent, etc., can be suppressed to separate from the surface of the toner particle.

As a manner of applying the mechanical impulsive force, one of following manners can be employed:

Specifically, a wing rotating at high speed applies an impulsive force to the mixture.

Otherwise, the mixture is thrown into a high-speed airflow and is accelerated, whereby respective particles mutually collide with each other or a combined particle collides with a prescribed collision plate or the like.

As an apparatus using such manner, Ang-mill manufactured by Hosokawa Micron Co, Ltd., an apparatus obtained by modifying and decreasing smash air pressure of 1-type Mill manufactured by Japan Pneumatic Corp, Hybridization system manufactured by Nara Machinery Corp, and Criptron System manufactured by Kawasaki Heavy Industrial Corp, and an automatic mortar or the like is exemplified.

Further, toner used in an image forming apparatus of the present invention preferably covered with external additives at its surface.

By doing so, an adherence between the toner and a photoconductive member is decreased and incomplete toner image transfer is hardly created.

As a coverage rate of the external additives, 10 to 90% is preferable, and 30 to 60% is more preferable.

Specifically, if it is less than 10%, adjusting the adherence therebetween to a prescribed preferable level becomes difficult, and causes the incomplete toner image transfer.

Whereas when it exceeds 90%, the external additives readily separate, and accordingly, parts such as a photoconductive member of the image forming apparatus tends to damaged as image formation is repeated.

The coverage rate of the external additives in relation to the superficial area of the toner particle can be measured by analyzing an image of a toner surface taken by an electronic microscope The external additives are preferably produced by blending a fine particle having an average primary particle diameter of from 50 to 150 nm with ultra fine particle having a less diameter than the fine particle.

The smaller particle diameter of external additives, the smaller adherence and lower aggregation.

However, when the average particle diameter is less than 50 nm, the external additives are necessarily embedded into a toner mother body surface when the toner is stirred for a long time period.

Owing to this, the toner adherence changes and increases the incomplete toner image transfer, and accordingly, quality of an image deteriorates.

Further, in proportion to a largeness of the particle diameter of the external additives, deformation of the mother body can be prevented highly likely when pressurized, and accordingly, increase of the toner in-between adherence ca n be suppressed.

However, when the external additives having the average particle diameter more than 150 nm is used, It readily separates from the mother body and attracts to the other member, thereby causing photoconductive member filming and an abnormal image.

Thus, to effectively avoid problems of increase of the adherence after toner compression and that caused when the toner is stirred for a long time while stabilizing aggregation and fluidity, external additives having average particle diameter of from 520 to 150 nm are blended and used to decrease the aggregation of the external additives having a small particle diameter.

Further, a shape of the external additives is preferably substantially spherical.

By doing so, it hardly embeds into the mother body even if stirred for a long time.

All of known external additives can be employed, but silica ($SiO^2$), titan oxide ($TgiO^2$), and aluminum ($Al^2O^3$) are preferably used.

When the external additives includes an organic fine particle having a hygroscopic property, it is preferably subjected to a hydrophobic process considering environmental stability.

A manner of executing the hydrophobic process, various manners can be optionally chosen upon need, and a manner of causing hydrophobic process agent to react with the above-mentioned fine particle at high temperature is exemplified.

As the hydrophobic process agent, various material can be optionally chosen upon need, and silane coupling agent and silicone oil or the like are exemplified.

A manner of externally adding the external additives can be optionally employed upon need.

For example, various mixing apparatus such as a V-type blender, Henshel Mixer, Mechanofusion or the like can be preferably exemplified.

The photoconductive member employed in various embodiments is not limited and includes various types upon need.

For example, a photoconductive member is preferably produced from a cylinder made of metal and an organic photoconductive semiconductor coated onto the periphery of the cylinder to serve as a photoconductive layer.

The contact angle formed by the photoconductive member surface and water is also not limited to one and optionally selected upon need, but is preferably not less than about 90 degree.

Specifically, if it is less than 960 degree, an adherence between tot and the photoconductive member increases, and tends to establishes the below described inequality, wherein Fbp represents an average non-electrostatic adherence between toner and an intermediate transfer belt, Fpp represents an average non-electrostatic adherence between toner and the photoconductive member when toner is pressurized by a centrifugal force at 1000 nN per particle:

$$Fpp>Fbp$$

Specifically, when the inequality Fpp>Fbp is established, the toner between adherence Ftp becomes large.

Whereas when the inequality Ftp>Fbp is established, the incomplete toner image transfer readily occurs.

When the inequality Ftp<Fbp is established, a transfer rate tends to decreases.

As the contact angle measurement, the automatic contact angle scalar CA-W manufactured by Kyowa Interface Science Co Ltd., can be used.

A manner of making the contact angle more than 90 degree is not limited to one, and is selected optionally upon need.

For example, a manner of decreasing surface energy on the photoconductive member can be exemplified.

A manner to decrease the surface energy on the photoconductive member surface is not limited, but can be optionally selected upon need.

However, a manner to add material having small surface energy to an organic photoelectric semiconductor constituting a photoconductive layer.

Otherwise, a manner to provide material having small surface energy while changing density thereof? in a thickness direction of the photoconductive layer is exemplified.

Yet otherwise, a manner of coating water shedding substance onto the surface of the photoconductive member is exemplified.

Polymers selected from tetrafluoroethylene, hexafluoropropylene, trifluoroethylene, chlorotrifluoroethylene, vinylidene fluoride, and vinyl fluoride, perfluoroalkyl vinyl ether, and copolymers of these polymers.

Metal soaps such as zinc stearate, aluminum stearate, and iron stearate.

Silicone oils such as dimethyl silicone oils, methylphenyl silicone oils, methylhydrodiene polysiloxane, cyclic dimethylpolysiloxane, alkyl-modified silicone oils, polyether-modified silicone oils, alcohol-modified silicone oils, fluorine-modified silicone oils, amino-modified silicone oils, mercapto-modified silicone oils, epoxy-modified silicone oils, carboxyl-modified silicone oils, and higher fatty acid-modified silicone oils.

Metal oxides such as titanium oxide, silica, aluminum oxide, zirconium oxide, tin oxide, antimony-doped tin oxide, and indium oxide.

As a manner of coating the water shedding substance onto the surface of the photoconductive member, the water shedding substance or the like is thinned in a appropriate solvent such as alcohol, and is then coated onto the upmost surface of the photoconductive member.

By doing this, the surface of the photoconductive member is changed to a low surface energy state, and accordingly, the condition of the contact angle is satisfied.

Silicone oils such as dimethyl silicone oils, methylphenyl silicone oils, methylhydrodiene polysiloxane, cyclic dimethylpolysiloxane, alkyl-modified silicone oils, polyether-modified silicone oils, alcohol-modified silicone oils, fluorine-modified silicone oils, amino-modified silicone oils, mercapto-modified silicone oils, epoxy-modified silicone oils, carboxyl-modified silicone oils, and higher fatty acid-modified silicone oils.

Silane coupling agents having an amino group such as γ-(2-aminoethyl)aminopropyltrimethoxysilane, and γ-(2-aminoethyl)aminopropyldimethoxysilane.

Silane coupling agents having a mercapto group such as γ-mercaptopropyltrimethoxysilane, and γ-mercaptopropylmethyldimethoxysilane.

Silane coupling agents having an epoxy group such as γ-glycidoxypropyltrimethoxysilane.

Titanium coupling agents such as isopropyltriisostearoyl titanate, isopropyltri (N-aminoethyl) titanate, isopropyltri (dioctylpyrophosphite) titanate, tetraoctylbis (ditridecylphosphite) titanate, tetra (2,2-diaryloxymethyl-1-butyl) bis(ditridecyl) phosphite titanate, and ispropyltrioctanoyl titanate.

Young's modulus of the intermediate transfer belt used in the various embodiments is preferably not more than 6000 Mpa.

The modulus is obtained by executing a tension test in accordance with JIS K7127.

Specifically, a tangent line is drawn on a stress-distortion curvature at an early stage distortion region thereof, and the inclination thereof is calculated.

It is found that the non-electrostatic adherence Fbp, caused between the toner and the intermediate transfer belt after compression of 2.6×104 (N/m2) applied by the centrifugal force per particle, likely becomes large, when Young's modulus of the intermediate transfer belt is small.

This is considered because when Young's modulus of the intermediate transfer belt is small, the intermediate transfer belt likely deforms upon receiving a pressure, whereby a contact area between the toner and the intermediate transfer belt increases, thereby an adherence increases.

The following inaction is more likely met when the adherence Fbp is large:

$$Fbp>Fpp.$$

In such a situation, the incomplete toner image transfer hardly occurs, because even if the Ftp becomes large and accordingly the below described inequality is established whereby toner aggregate likely occurs upon receiving compression force, the toner aggregate moves toward the intermediate transfer belt in a group.

Whereas when Young's modulus of the intermediate transfer belt exceeds 6000 Mpa, since the intermediate transfer belt side hardly deforms, the toner layer receives an intensive pressure during a transfer process, whereby the aggregate likely occurs.

In addition, since the adherence between the toner and the intermediate transfer belt is small, the aggregate becomes mote likely remains on the photoconductive member side, resulting in significant incomplete toner image transfer.

PC (polycarbonate), PVDF (polyvinylidene fluoride), PAT (polyalkylene terephthalate), blended materials such as PC/PAT, ETFE (ethylene-tetrafluoroethylene copolymer)/PC, ETFE/PAT, and polyimide in which carbon black is dispersed.

The intermediate transfer belt used in various embodiments in this invention preferably partially includes an elastic layer.

The elastic layer can include a foam member layer.

Further, the intermediate transfer belt can include multi layer configuration, and preferably includes a non-foam member layer when the foam member layer is included therein.

When the surface layer includes the foam member layer, a transfer rate of a secondary transfer process decreases due to entrance of toner into holes formed on the surface layer or presence of excessive adherence.

Specific examples of the materials for use in the fourth layer 11*d* include polycarbonate resins, fluorine-containing resins (such as ETFEs and PVDFs), homopoloymers or copolymers of styrene or styrene derivatives such as polystyrene resins, chloropolystyrene resins, poly-α-methylstyrene resins, styrene-butadiene copolymers, styrene-vinyl chloride copolymers, styrene-vinyl acetate copolymers, styrene-maleic acid copolymers, styrene-acrylate copolymers (e.g., styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (e.g., styrene-methyl methacrylate copolymers, styrene-ethyl methacrylate copolymers, and styrene-phenyl methacrylate copolymers), styrene-methyl α-chloroacrylate copolymers, and styrene-acrylonitrile-acrylate copolymers; methyl methacrylate resins, butyl methacrylate resins, ethyl acrylate resins, butyl acrylate resins, modified acrylic resins (e.g., silicone-modified acrylic resins, vinyl chloride resin-modified acrylic resins, and acrylic urethane resins), vinyl chloride resins, vinyl chloride-vinyl acetate resins, rosin-modified maleci acid resins, phenolic resins, epoxy resins, polyester resins, polyester polyurethane resins, polyethylene, polypropylene, polybutadiene, polyvinylidene chloride, ionomer resins, polyurethane, silicone resins, ketone resins, ethylene-ethyl acrylate copolymers, xylene resins, polyvinyl butyral, polyamide modified phenylene oxide resins, etc. These resins are used alone or in combination.

Specific examples of the rubbers for use in the third layer 11*c* include butyl rubbers, fluorine-containing rubbers, acrylic rubbers, EPDMs, NBRs, acrylonitrile-butadiene-styrene rubbers, natural rubbers, isoprene rubbers, styrene-butadiene rubbers, butadiene rubbers, ethylene-propylene rubbers, ethylene-propylene terpolymers, chloroprene rubbers, chlorosulfonated polyethylene, chlorinated polyethylene, urethane rubbers, syndiotactic 1,2-polybutadiene, epichlorohydrin rubbers, silicone rubbers, fluorine-containing rubbers, polysulfide rubbers, polynorbornene rubbers, hydrogenated nitrile rubbers, elastomers (e.g., polyethylene elastomers, polyolefin elastomers, polyvinyl chloride elastomers, polyurethane elastomers, polyamide elastomers, polyurea elastomers, polyester elastomers, and fluorine-containing elastomers), etc. These materials can be use alone or in combination.

Foamed materials of thermoplastic resins such as polyethylene, polyvinyl chloride, polystyrene, polyvinyl alcohol, viscose, and ionomer, and foamed materials of thermosetting resins such as polyurethane, rubbers, epoxy resins, phenolic urea resins, pyran resins, silicone resins, and acrylic resins.

When a urethane foam material is used for the foamed layer, any polyols such as hydrophobic or hydrophilic polyols can be used for forming the urethane foam material. Among these polyols, polypropylene glycol and polyether polyols such as ethylene oxide adduct type polyols are preferable.

One or more of the layers can include an electroconductive material for controlling the resistance of the layers. Specific examples thereof include carbon black, graphite, powders of metals such as aluminum and nickels, metal oxides such as tin oxide, titanium oxide, antimony oxide, indium oxide, potassium titanate, antimony oxide-tin oxide complex oxides (ATO), and indium oxide-tin oxide complex oxides (ITO), but are not limited thereto. The electro conductive metal oxides may be coated with a particulate insulating material such as barium sulfate, magnesium silicate and calcium carbonate.

Further, the surface energy of the surface layer is preferably suppressed.

Thus, polyurethane, polyester, epoxy resin or the like or more than one combination of these are used.

Further, lubricity material, such as fluorocarbon resin, fluorine compound, carbon-fluorine, titanium dioxide, silicone carbide or the like and more than one combination of those or a those combination having different particle diameter from the other can be used being dispersed.

Further, a fluorine-enriched layer is formed on the surface by applying a heat processing, and such a fluorine rubber material can be used to decrease the surface energy.

The transfer member layer can be manufactured in various manners, such as a centrifugal molding manner in that material is poured into a cylindrical rotating mold to produce a belt, a spray manner in that liquid paint is sprayed to produce a film, a dipping manner in that a cylindrical mold is dipped into material liquid and is then lifted up, an injection manner in that material is injected between inner and outer molds, and a manner in that a compound is wound around a cylindrical mold and is then subjected to vulcanized latex processing or the like.

However, it is not limited to the above, and can employ yet another manners for example by combining plural production manners as commonly used.

This intermediate transfer belt has a structure such that a rubber layer (such as the third layer) is formed on a resinous core layer (such as the fourth layer) to prevent stretching of the elastic belt. One or more materials which can prevent stretching of the belt can be included in the core layer (such as fourth layer). Specific examples of the stretch preventing materials include natural fibers such as cotton fibers and silk fibers; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers and phenolic fibers; inorganic material fibers such as carbon fibers, glass fibers and boron fibers; metal fibers such as iron fibers and copper fibers; etc. These materials are used alone or in combination. In addition, the fibers can have a form of woven cloth or yarn.

The material is not limited thereto. For example, the fiber may be constituted of single filament or plural filaments, which are twisted. Specific examples of the twisted yarns include single-twisted yarn, double-twisted yarn, two-folded yarn, etc. In addition, blended fabrics constituted of two or more of the above-mentioned fibers. In addition, the fiber can be subjected to an electro conductive treatment. The weaving method is not particularly limited, and any known weaving methods such as stockinet can be used. In addition, clothes made by weaving two or more of the above-mentioned fibers can also be used. The clothes can be subjected to an electro conductive treatment.

A manner of providing a core member layer is not limited.

For example, a manner of covering a metal mold with textile fabrics shaped in a cylindrical shape and arranging a coat layer thereon is exemplified.

Further, a manner of soaking textile fabric loomed in a cylindrical shape into liquid rubber or the like and arranging it on either one or both sides on a core member layer as a coat layer or layers is exemplified.

Further, a manner of winding thread around a metal mold or the like at a prescribed pitch in a spiral state and arranging a coat layer thereon is exemplified.

The thickness of the elastic layer depends on hardness thereof, but likely creates crack on the surface layer due to growing of expansion thereof when being too thick.

In addition, due to large shrinkage and expansion of an image, excessively thick layer having ore than about 1 mm is not preferable.

Further, a cubic resistance rate of the intermediate transfer belt used in the various embodiments of this invention is preferably from $10^7$ to $10^{12}$ ohmicrometer.

The intermediate transfer belt preferably includes an elastic layer to control Young's rate and repelling elasticity.

Control of a resistance is significant as well.

When the cubic resistance rate of the intermediate transfer belt exceeds the above-mentioned range, since a bias needed for transfer process increases, power supply becomes costly.

In addition, since a charge voltage of the intermediate transfer belt increases in transferring and transfer sheet separating steps or the like and self-discharge become difficult, a charge-removing device is needed.

Further, when the cubic resistance rate of the intermediate transfer belt deviates less than the above-mentioned range, Since decreasing of the charge voltage is promoted, toner scattering occurs after transfer process admitting that the charge removal by means of self-discharge is advantageous.

Now, various examples of electro-photographic toner are described hereinafter.

Initially, a first example is described.

Composition of toner binder is produce.

Into a reaction tank with a cooling pipe, a stirring machine and a nitride inlet pipe, polyoxyethylene (2,2)-2,2-bis(4-hydroxyfenole) propane 810 (parts), terephthalic acid 300 (parts), and dibutyltin oxide 2 (parts) are poured and make them react for eight hours under ordinary pressure at 230 degree centigrade.

Further, they are treated by decreasing the pressure down to a level of 10 to 15 mmHg for five hours to be cooled down to 160 degree centigrade.

Phthalic anhydride of 32 parts is added thereto to execute reaction for two hours.

The following components were fed into a reaction vessel equipped with a condenser, an agitator, and a nitrogen feed pipe.

| | |
|---|---|
| Poloyoxyethylene (2.2)-2,2-bis (4-hydroxyphenol) propane | 810 parts |
| Terephthalic acid | 300 parts |
| Dibutyltin oxide | 2 parts |

The mixture was heated to 230° C. to perform a reaction for 8 hours under normal pressure. The reaction was further continued for 5 hours under a reduced pressure of from 10 to 15 mmHg (1.3 to 2.0 Pa). After the reaction product was cooled to 160° C., 32 parts of phthalic anhydride was added thereto.

Subsequently, it is cooled down to 80 degree centigrade and is reacted with Isophorone Diisocyanate of 188 parts for two hours in ethyl acetate, and isocyanate inclusion prepolymer 1 is obtained.

Then, the prepolymer 1 of 267 parts and Isophorone diamine of 14 parts are reacted with each other at 50 degree centigrade for two hours, whereby urea denaturate polyester 1 having weight average molecule amount of 58000 is obtained.

Similar to the above, bisphenol A ethylene oxide-two molecule additives of 724 parts, and terephthalic acid of 276 parts are subjected to polycondensation reaction at 250 degree centigrade for 5 hours.

Then, the pressure is decreased down to a range from 10 to 15 mmHg and reaction is continued for five hours, whereby natural polyester a having peak molecule amount of 5000.

Urea denatured polyester 1 of 200 parts and natural polyester "a" of 800 parts are melted and mixed in ethyl acetate solvent of 2000 parts, whereby toner binder of ethyl acetate liquid? is obtained.

Such binder is partially dehydrated by decreasing pressure, and substance performance of the toner binder 1 is measured, and found that a peak of MW distribution is 5500, Tg is 71 degree centigrade, and acid number is 5.5.

After the reaction product was cooled to 80° C., the reaction product was mixed with 188 parts of isophorone diisocyanate to perform a reaction for 2 hours. Thus, an isocyanate-containing prepolymer (1) was prepared.

Next, the following mixture was reacted for 2 hours at 50° C. to prepare a urea-modified polyester (1) having a weight average molecular weight of 58,000.

| | |
|---|---|
| Prepolymer (1) | 267 parts |
| Isophorone diamine | 14 parts |

Similarly to the above-mentioned reaction, the following components were subjected to a polycondensation reaction for 5 hours at 250° C. under a normal pressure, followed by a reaction for 5 hours under a reduced pressure of from 10 to 15 mmHg (1.3 to 2.0 Pa).

| | |
|---|---|
| Ethylene oxide (2 mole) adduct of bisphenol A | 724 parts |
| Terephthalic acid | 276 parts |

Thus, an unmodified polyester (a) having a peak molecular weight of 5,000 was prepared.

Next, 200 parts of the urea-modified polyester (1) and 800 parts of the unmodified polyester (a) were dissolved in 2,000 parts of ethyl acetate to prepare an ethyl acetate solution of a toner binder (1). Part of the solution was dried under a reduced pressure to measure physical properties of the solid toner binder (1). As a result, it was confirmed that the toner binder has a glass transition temperature of 71° C., an acid value of 5.5 mgKOH/g, and a molecular weight distribution such that a peak is observed at 5,500.

Now, exemplary production of toner is described.

In a beaker, the above-mentioned toner binder 1 of ethyl acetate liquid of 240 parts and copper phthalocyanine blue pigment of four parts are poured.

Then, they are stirred and uniformly melted and dispersed in TK type homomixer by 12000 rpm at 60 degree centigrade.

Further, in the beaker, ion exchange water of 706 parts,

Hydroxyapatite 10% suspension (Super tight manufactured by Japan Kagaku Industry Co, Ltd.) of 294 parts, and dodecylbenzenzulfonic acid sodium of 0.2 parts are poured and are uniformly melted.

Then, temperature is increased to 60 degree centigrade, and the above-mentioned toner material is throw in while being stirred by the TK type homomixer at 12000 rpm for ten minutes.

Then, the mixture is moved to a flask with a stirring bar and a heat gauge, and temperature is increased to 98 degree centigrade.

Then, the solvent is removed and the mixture is subjected to filtering, washing, dehydrating, and wind force classification, whereby a mother particle is obtained.

As the charge control agent, salicylic acid derivatives of zinc salt of 4.0 weight % of toner amount is mixed and is stirred in a warming ambient.

Thus, the charge control agent is firmly attracted to the surface of the toner, whereby a toner mother particle A having an average roundness of 1.26 and a cubic average particle diameter of 5.2 micrometer is obtained.

With the toner mother particle A, dehydrated silica A (e.g. primary average particle diameter of 25 nm) of 0.85 weight % of a toner amount, and dehydrated titan oxide A (e.g. primary average particle diameter of 15 nm) of 0.95 weight % of the toner amount are blended and are subjected to a stirring mixing process in the Henshen Mixer, whereby the toner particle of the first example is produced.

Incomplete toner image transfer evaluation is then executed as to the toner obtained in the above-mentioned first example using a color copier "Imagio Neo C7500 improved version" manufactured by Ricoh Co, Ltd, while applying a transfer pressurizing spring force of 16N without lubricant being coated onto a photoconductive member or a transfer belt of the copier.

The transfer pressurizing spring force is the sum of spring forces applied to both side ends of a transfer roller. The incomplete toner image transfer is checked using a test chart and an output image is evaluated and ranked from first to fifth, wherein the first is worst and the fifth is best. The ranks not lower than fourth don't raise a problem. The test chart includes uniformly arranged thin lines of three dots in the main scanning direction and 60 dots in the sub scanning direction.

These evaluation ranks represents as follows: Specifically, a fifth rank represents a condition, in which incomplete toner image transfer is not visually observed.

A fourth rank represents a condition, in which incomplete toner image transfer is hardly or barely visually observed. A third rank represents a condition, in which incomplete toner image transfer is barely visually observed, but does not deteriorate image quality. A second rank represents a condition, in which incomplete toner image transfer is readily visually observed, relatively. A first rank represents a condition, in which incomplete toner image transfer is immediately visually observed by every observer.

A contact angle of the photoconductive member in relation to water is about 80 degree. The intermediate transfer belt includes a single layer in large part principally made of polyimide having thickness of 60 micrometer with Young's modulus of 6800 Mpa.

Using the centrifugal separation method, toner is compressed by a compression force of $2.6\times10^4$ ($N/m^2$) per particle in the first example and the adherence Ftp between toners, the adherence Fpp between the toner and the photoconductive member, and the adherence Fbp between the toner and the intermediate transfer belt after compression are then measured.

Specifically, as a photoconductive member, a virgin photoconductive member mounted on the color copier "Imagio Neo C7500" manufactured by Ricoh Co, Ltd., is used.

As an intermediate transfer belt, the intermediate transfer belt used in the color copier is utilized. An adherence between toners is measured when compression force is 0 (nN) and an inclination L of Ftp/Dt is calculated in relation to the compression force.

An apparatus for measuring the adherence and a measurement condition are as follows:

Centrifugal separation apparatus: CP100 Alpha manufactured by Hitachi Koki Co, Ltd (Maximum rpm: 100000, Maximum accelerated speed: 800000 G), Rotor: Angle Rotor P100AT manufactured by Hitachi Koki Co, Ltd, Image Processing Apparatus: Image Hyper700 manufactured by Inter Quest, Sample Substrate and Reception Substrate: Disk having diameter of 8 mm and thickness of 1.5 mm, made of Aluminum, Spacer: Ring having outer diameter of 8 mm, inner diameter of 5.2 mm, and thickness of 1 mm, made of Aluminum, Holding Member Cylinder having diameter of 13 mm and length of 59 mm, made of Aluminum, and Distance from central axis of Rotor to toner attraction surface of Sample Substrate: 64.5 mm.

As a result of the measurement, the Fpp, Fbp, and Ftp as well as the inclination L of Ftp/Dt of the toner of the above-mentioned first example are obtained as follows:

$$Fpp=87\ [nN],\ Fbp=55\ [nN],\ Ftp=50\ [nN],\ \text{and}\ L=1.64\times10^4.$$

Incomplete toner image transfer is ranked fourth.

A first comparative example is then prepared and experienced.

Resin and colorant or the like serving as toner composition are blended and stirred, and are then melted and mixed.

After that, the composition is smashed and classified, whereby indeterminate form toner mother particle B is obtained.

The cubic average particle diameter of the toner mother particle B is about 7.0 micrometer, and an average roundness thereof is about 1.55.

To the toner mother particle B, toner amount 0.7 weight % of silica A (e.g. primary particle diameter average: 25 nm) subjected to a hydrophobic nature processing, and toner amount 0.8 weight % of Titanium oxide A (e.g. primary particle diameter average 15 nm) subjected to the hydrophobic nature processing are compounded, and are stirred and mixed by Henshel mixer, whereby the toner particle of the first comparative example is produced.

Similar to the first example, the adherences Fpp, Fbp, and Ftp as well as the inclination L are calculated using the toner obtained in this comparative first example and incomplete toner image transfer evaluation thereof is obtained as follows:

$$Fpp=115\ [nN],\ Fbp=75\ [nN],\ Ftp=85\ [nN],\ \text{and}\ L=4.29\times10^{-4}.$$

The incomplete toner image transfer is ranked first.

In the first comparative example, since the roundness of the toner is high, t is considered that the adherence between toners after the compression largely increases.

As a result, the adherence Ftp becomes larger than that of Fbp and the incomplete toner image transfer increases.

A second example is then prepared and experienced.

The toner mother particle B is similarly produced as the first comparative example and is heated higher than a softening point of binder resin in the thermal current atmosphere to receive a spherical form processing.

Then, the toner mother particle B is classified, whereby a spherical form toner mother particle C is produced.

A cubic average particle diameter of the toner mother particle C is about 7.0 micrometer.

An average of roundness of toner mother particle C is about 1.21.

To the toner mother particle C, toner amount 0.7 weight % of silica A (e.g. primary particle diameter average: 25 nm) subjected to a hydrophobic nature processing, and toner amount 0.8 weight % of Titanium oxide A (e.g. primary particle diameter average: 15 nm) subjected to the hydrophobic nature processing are compounded and are stirred and mixed by Henshel mixer, whereby the toner particle of the second example is produced.

Similar to the first example, the adherences of Fpp, Fbp, and Ftp as well as the inclination L are calculated using the toner obtained in this second example, and incomplete toner image transfer evaluation thereof is obtained as follows:

$$Fpp=85\ [nN],\ Fbp=52\ [nN],\ Ftp=41\ [nN],\ \text{and}\ L=1.87\times10^{-4}.$$

The incomplete toner image transfer is ranked fifth.

A third example is then prepared and experienced using toner having a cubic average particle diameter of about 7.0 micrometer and an average roundness of about 1.55 similar to the first comparative example.

However, lubricant is coated on the photoconductive member of the same image forming apparatus used in the first example.

As the lubricant, zinc stearate is used.

The adherence is measured as to the photoconductive member coated with the lubricant.

By changing a coating amount of the lubricant, the contact angle formed by the photoconductive member and water is maintained at more than 92 degree.

Similar to the first example, the adherences of Fpp, Fbp, and Ftp as well as the inclination L are calculated using the toner obtained in this example, and incomplete toner image transfer evaluation thereof is obtained as follows:

$$Fpp=59\ [nN],\ Fbp=75\ [nN],\ Ftp=85\ [nN],\ \text{and}\ L=4.29\times10^{-4}.$$

The incomplete toner image transfer is ranked fifth.

In the third example, since the photoconductive member is coated with the lubricant, it is considered that the adherence of the photoconductive member drum decreases even if the same toner is used as in the first comparative example.

As a result, the adherence Ftp becomes smaller than that of Fbp, and the incomplete toner image transfer is improved to the fifth rank.

A second comparative example is then prepared and experienced by using toner having a cubic average particle diameter of about 5.8 micrometer and an average roundness of about 1.34 similar to the first example.

However, the lubricant is coated on the intermediate transfer belt of the same image forming apparatus as the first example. As the lubricant, zinc stearate is used. The adherence is measured as to the intermediate transfer belt coated with the same lubricant.

Similar to the first example, the adherences of Fpp, Fbp, and Ftp as well as the inclination L are calculated using the toner obtained in this second comparative example, and incomplete toner image transfer evaluation thereof is obtained as follows:

$$Fpp=82\ [\text{nN}],\ Fbp=27\ [\text{nN}],\ Ftp=32\ [\text{nN}],\ \text{and}\ L=1.64\times10^{-4}.$$

The incomplete toner image transfer is ranked second.

In the second comparative example, since the intermediate transfer belt is coated with the lubricant, it is considered that the adherence to the intermediate transfer belt decreases even if the same toner is used as in the first example.

As a result, the adherence Ftp becomes larger than that of Fbp, and the incomplete toner image transfer increased and ranked down to a lower level.

A fourth example is prepared and experienced. Specifically, toner having an average roundness of about 1.52 as used in the first comparative example and that having an average roundness of about 1.21 as used in the second example are blended at a ratio of 1 vs. 1, whereby toner having a cubic average particle diameter of about 7.0 micrometer and an average roundness of about 1.38 is produced.

Similar to the first example, the adherences of Fpp, Fbp, and Ftp, as well as the inclination L are calculated using the toner obtained in this fourth example, and incomplete toner image transfer evaluation thereof is obtained as follows:

$$Fpp=89\ [\text{nN}],\ Fbp=60\ [\text{nN}],\ Ftp=57\ [\text{nN}],\ \text{and}\ L=3.13\times10^{4}.$$

The incomplete toner image transfer is ranked fourth.

Hence, by blending the toners having different roundness from each other, the toner having the high roundness and readily causing the incomplete toner image transfer can be used while avoiding the incomplete toner image transfer.

A fifth example is then prepared and experienced. Specifically, similar to the first comparative example, resin and colorant or the like serving as toner composition are blended and stirred, and are then melted and mixed.

After that, the composition is smashed and classified, whereby indeterminate form toner mother particle D is obtained.

A cubic average particle diameter of the toner mother particle D is about 3.6 micrometer, and an average roundness thereof is about 1.55.

Toner amount 1.35 weight % of silica A (e.g. primary particle diameter average: 25 nm) subjected to a hydrophobic nature processing, and toner amount 1.5 weight % of titanium oxide A (e.g. primary particle diameter average: 15 nm) subjected to the hydrophobic nature processing are compounded, and are stirred and mixed by Henshel mixer, whereby toner is produced. The thus produced toner has a cubic average particle diameter about 3.6 and is blended with the toner of the first comparative example having the cubic average particle diameter about 7.0 and the average roundness of about 1.55 at a ratio of 1 vs. 1, thereby the toner of the fifth example is produced.

Similar to the first example, the adherences of Fpp, Fbp, and Ftp as well as the inclination L are calculated using the toner obtained in this fifth example, and incomplete toner image transfer evaluation thereof is obtained as follows:

$$Fpp=87\ [\text{nN}],\ Fbp=49\ [\text{nN}],\ Ftp=30\ [\text{nN}],\ \text{and}\ L=1.72\times10^{-4}.$$

Incomplete toner image transfer is ranked fourth.

In this way, since the toner having different average particle diameter from each other are blended, a replenishment rate increases more than when almost same level average particle diameter toner is used, and as a result, it is considered that increase of the adherence between toners having been subjected to compression is suppressed, and as a result, the incomplete toner image transfer is suppressed.

A sixth example is then prepared and experienced.

An evaluation of the same toner is executed based on the same condition as in the first comparative example except for employment of a newly produced intermediate transfer belt.

The intermediate transfer belt is produced in the below-described manner.

In relation to 100 weight parts resin compound included in polyimide varnish, CB of 20 weight parts is added and is uniformly dispersed.

They are then poured into a cylindrical mold that rotates at 1000 rpm and are subjected to a centrifugal molding at 130 degree centigrade for 100 minutes while being dried.

A polyimide film peeled off from the mold is wrapped around a cylinder mold and is subjected to a hardening process at 300 degree centigrade.

Then, compound including NBR rubber of 100 weight parts, vulcanized agent (e.g. precipitated sulfur) of 2 weight parts, CB of 20 weight parts, and elasticizer of 30 weight parts is wound around the above-mentioned polyimide film and is subjected to heat vulcanization at 150 degree centigrade for 80 minutes.

The compound is then polished and is coated in a spray manner with dispersion liquid that includes uniform dispersion of polyurethane prepolymer of 100 weight parts, curing agent (e.g. isocianate) of 3 weight parts, PTFE fine particle powder of 50 weight parts, dispersant of 4 weight parts, and MEK of 500 weight parts.

The compound is then dehydrated at 130 degree centigrade for 100 minutes.

In this way, the intermediate transfer belt having a resin layer of 90 micrometer and an elastic layer of 80 micrometer is obtained.

Young's modulus is 5400 Mpa.

The result of evaluation of adherences of Fpp, Fbp, and Ftp, as well as the inclination L are as follows:

$$Fpp=115\ [\text{nN}],\ Fbp=124\ [\text{nN}],\ Ftp=85\ [\text{nN}],\ \text{and}\ L=4.29\times10^{4}.$$

The incomplete toner image transfer is ranked fifth.

Thus, Young's modulus can decrease if the elastic layer is arranged on the intermediate transfer belt.

As a result, the Fbp becomes larger than the Fpp, and the incomplete toner image transfer hardly occurs.

A third comparative example is then prepared and experienced as follows:

Mother toner particles B' is produced by smashing and classifying the toner used in the first comparative example to have a cubic average particle diameter of about 4.0 micrometer, an average roundness of about 1.56. The same external additive is added thereto in the same coverage rate as the first comparative example.

Similar to the first comparative example, the adherences of Fpp, Fbp, and Ftp as well as the inclination L are calculated using the toner obtained in this third comparative example, and incomplete toner image transfer evaluation thereof is obtained as follows:

$Fpp$=64 [nN], $Fbp$=43 [nN], $Ftp$=51 [nN], and $L=4.50\times10^{-4}$.

The incomplete toner image transfer is ranked first.

A seventh example is produced and experienced.

That is, mother toner particles C' is produced by heating the mother toner particles B' in temperature more than softening point for combination resin in a thermal current and applying a balling process, and further classifying the same to have a cubic average particle diameter of about 4.0 micrometer and an average roundness of about 1.23.

Similar to the first comparative example, the adherences of Fpp, Fbp, and Ftp as well as the inclination L are calculated using the toner obtained in this example, and incomplete toner image transfer evaluation thereof is obtained as follows:

$Fpp$=48 [nN], $Fbp$=30 [nN], $Ftp$=23 [nN], and $L=1.85\times10^{-4}$.

Incomplete toner image transfer is ranked fifth.

Based on the first and third comparative examples as well as the second and seventh practical examples, it is realize when the adherences of the Fpp, Fbp, and Ftp are compared with each other that incomplete toner image transfer relies on the toner shape regardless of the particle diameter when the compression force of $2.6\times10^4$ (N/m2) is applied.

Now, a fourth comparative example is produced and experienced.

In a beaker, the toner binder of ethyl acetate liquid of 240 parts obtained in the first example and copper phthalocyanine blue pigment of four parts are poured.

Then, they are stirred and uniformly melted and dispersed in TK type homomixer by 12000 rpm at 60 degree centigrade.

Further, in the beaker, ion exchange water of 706 parts, Hydroxyapatite 10% suspension (e.g. "Super Tight 10" manufactured by Japan Kagaku Industry Co, Ltd.) of 294 parts, and dodecylbenzenzulfonic acid sodium of 0.2 parts are poured and are uniformly melted.

Then, temperature is increased to 60 degree centigrade, and the above-mentioned toner material is thrown in while being stirred by the TK type homomixer at 12000 rpm for ten minutes.

Then, the mixture is moved to a flask equipped with a stirring bar and a heat gauge, and temperature is increased to 35 degree centigrade.

Then, the solvent is removed and the mixture is subjected to filtering, washing, dehydrating, and wind force classification for nine hours under decompression, whereby a mother particle E is obtained.

As the charge control agent, salicylic acid derivatives of zinc salt of 4.0 weight % of toner amount is mixed with toner and are stirred in a warming ambient, whereby the charge control agent is firmly attracted to the surface of the toner, and toner mother particle E' having an average roundness of 1.47 and a cubic average particle diameter of 5.9 micrometer is obtained.

With the toner mother particle E', dehydrated silica A (e.g. primary average particle diameter of 25 nm) of 0.85 weight % of a toner amount, and dehydrated titan oxide A (e.g. primary average particle diameter of 15 nm) of 0.95 weight % of a toner amount are blended and are subjected to a stirring mixing process in the Henshen Mixer, whereby toner particle of the fourth comparative example is produced.

Similar to the first example, the adherences of Fpp, Fbp, and Ftp, as well as the inclination L are calculated using the toner obtained in this comparative example, and incomplete toner image transfer evaluation thereof is obtained as follows:

$Fpp$=107 [nN], $Fbp$=70 [nN], $Ftp$=76 [nN], and $L=3.50\times10^{-4}$.

Incomplete toner image transfer is ranked second.

In the comparative example 4, since the roundness of the toner is high, the adherence between toners is supposed to largely increase after application of the compression force thereto. As a result, the Ftp becomes larger than the Fbp, and the incomplete toner image transfer becomes worse.

All of the adherences Fpp, Fbp, and Ftp, as well as the inclinations L of Ftp/Dt in relation to the compression forces applied by the centrifugal force per toner particle in the respective examples and the comparative examples, roundness of toner, and exemplary incomplete toner image transfer ranks evaluated under the transfer pressuring spring force 16 (N) are listed on table 1.

As mentioned, the Ftp represents the toner between adherence, and Dt represents the toner average particle diameter when centrifugal forces applied in the respective examples of 1 to 7, as well as the comparative examples 1 to 3.

As shown, the below described inequalities are established, when the compression force of $2.6\times10^4$ (N/m$^2$) is applied per particle by the centrifugal forces in the first to fifth examples;

$Fbp>Ftp$, or $Fbp>Fpp$.

Specifically, the incomplete toner image transfer rank is relatively high when the transfer pressurizing spring force is 16 (N), and a fine image is obtained even when an image forming apparatus is ordinarily used.

Figure 11:
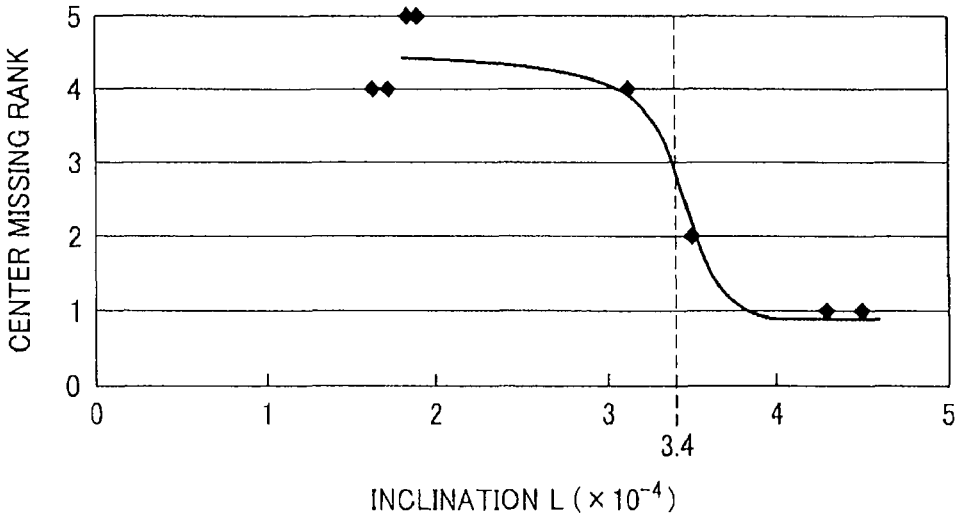
FIG. 11 is a graph illustrating practical and comparative experiment results on lateral and vertical axes indicating an inclination L and a toner incomplete transfer rank, respectively.

As understood from FIG. 11, incomplete toner image transfer is preferably avoided when toner having a proportional coefficient L of a primary regression straight line not more than $3.40\times10^4$ (mm), which is plotted on a graph that indicates a parameter Ftp/Dt [nN/μm] on a vertical axis and a parameter P (N/m2) on a lateral axis.

The parameter Ftp/Dt [nN/μm] represents a value obtained by dividing the non-electrostatic adherence (Ftp (nN)) between toners by an average diameter of toner (Dt (micrometer)), while the parameter P (N/m2) represents a compression force applied to the toner per particle. Each of the parameters is obtained after the compression of the centrifugal force. Thus, such toner is preferably used in the several embodiments.

Further, as recognized, when the examples of 1, 2, 4 and 7 are compared with the comparative ones of 1 and 3 each employing the same surface conditioned photo-conductive member and inter mediate transfer belt using the toner of the same particle diameter, toner having average roundness of from 1.0 to 1.4 preferably able to avoid the incomplete toner transfer. Thus, when such toner is used, since spherical toner tends to increase a toner adherence after the compression, preferable result can be obtained.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus comprising:

a first image bearer configured to bear a latent image and a toner image comprising toner which includes toner particles;

a second image bearer including an intermediate transfer member;

a first transfer device configured to transfer the toner image from the first image bearer to the second image bearer; and a second transfer device configured to transfer the toner image from the second image bearer to a printing medium;

wherein one of the below described inequalities exists for the toner when subjected to centrifugal force of $2.6\times10^4$ ($N/m^2$) per particle, wherein Ftp represents a non-electrostatic adherence between the toner particles, Fpp represents a non-electrostatic adherence between the toner and the first image bearer, and Fbp represents a non-electrostatic adherence between the toner and the second image bearer;

$Fbp>Ftp$ and $Fbp>Fpp$.

2. The image forming apparatus as claimed in claim 1, wherein said toner has a proportional coefficient L of a primary regression straight line not more than $3.40\times10^4$ (mm), wherein said primary regression straight line being plotted on a graph indicating a parameter Ftp/Dt [nN/μm] on a vertical axis and a parameter P ($N/m^2$) on a lateral axis, said parameter Ftp/Dt [nN/μm] representing a value obtained by dividing the non-electrostatic adherence (Ftp (nN)) between the toner by an average diameter of the toner particles (Dt (micrometer)), said parameter P ($N/m^2$) representing a pressurizing force applied to the toner, and wherein each of the parameters are obtained after the compression by the centrifugal force.

3. The image forming apparatus as claimed in claim 2, wherein an average roundness of the toner particles is from not less than 1.0 to not more than 1.4.

4. The image forming apparatus as claimed in claim 3, wherein said toner includes a mixture of groups of toner having an average roundness of not less than about 1.4 and not more than about 1.4.

5. The image forming apparatus as claimed in claim 4, wherein said average diameter of the toner particles ranges from 1 to 8 micrometers.

6. The image forming apparatus as claimed in claim 5, wherein said toner includes a mixture of at least two types of toner particles each having a different diameter from the other type.

7. The image forming apparatus as claimed in claim 6, wherein one of said at least two types of toner particles includes a larger particle having a diameter of from 4 to 8 micrometers, and a smaller particle having a diameter of from 1 to 4 micrometers.

8. The image forming apparatus as claimed in claim 7, wherein a contact angle of said first image bearer with water is not less than 90 degrees.

9. The image forming apparatus as claimed in claim 8, wherein a Young's modulus of the second image bearer is not more than 6000 Mpa.

10. The image forming apparatus as claimed in claim 9, wherein said second image bearer includes an elastic layer.

11. An image forming apparatus comprising:

a first image bearer configured to bear a latent image and a toner image comprising toner which includes toner particles;

a second image bearer including an intermediate transfer member;

a first transfer device configured to transfer the toner image from the first image bearer to the second image bearer; and a second transfer device configured to transfer the toner image from the second image bearer to a printing medium;

wherein the below described inequalities are established for the toner when subjected to a centrifugal force of $2.6\times10^4$ ($N/m^2$) per particle, wherein Ftp represents a non-electrostatic adherence between the toner particles, Fpp represents a non-electrostatic adherence between the toner and the first image bearer, and Fbp represents a non-electrostatic adherence between the toner and the second image bearer;

$Fbp>Ftp$ and $Fbp>Fpp$.

* * * * *